US012669264B2

(12) United States Patent
Higgins et al.

(10) Patent No.: US 12,669,264 B2
(45) Date of Patent: Jun. 30, 2026

(54) SOUND ISOLATING VENTILATION PANELS AND METHODS FOR MANUFACTURING SAME

(71) Applicant: VANAIR DESIGN INC., Burnaby (CA)

(72) Inventors: James Higgins, North Vancouver (CA); Vicking Wai King Yau, Burnaby (CA)

(73) Assignee: VANAIR DESIGN INC., Burnaby (CA)

( * ) Notice: Subject to any disclaimer, the term of this patent is extended or adjusted under 35 U.S.C. 154(b) by 168 days.

(21) Appl. No.: 18/578,105

(22) PCT Filed: Jul. 7, 2022

(86) PCT No.: PCT/CA2022/051067

§ 371 (c)(1),
(2) Date: Jan. 10, 2024

(87) PCT Pub. No.: WO2023/283723

PCT Pub. Date: Jan. 19, 2023

(65) Prior Publication Data

US 2025/0003630 A1 Jan. 2, 2025

Related U.S. Application Data

(60) Provisional application No. 63/220,827, filed on Jul. 12, 2021.

(51) Int. Cl.
*F24F 13/24* (2006.01)

(52) U.S. Cl.
CPC ..... *F24F 13/24* (2013.01); *F24F 2013/242* (2013.01)

(58) Field of Classification Search
CPC ..... F24F 13/24; F24F 2013/242; E04B 2001/8452; E04B 2001/8485; E04B 2001/8449; E04B 2001/8495
(Continued)

(56) References Cited

U.S. PATENT DOCUMENTS 2,272,829 A * 2/1942 Bohnsack ..... E04B 2/7409 52/145
3,963,094 A * 6/1976 Nowikas ..... E04B 1/8218 181/198

(Continued)

FOREIGN PATENT DOCUMENTS

EP 3120086 B1 3/2021
FR 3095828 B1 6/2021

(Continued)

*Primary Examiner* — Jeremy A Luks
(74) *Attorney, Agent, or Firm* — Oyen Wiggs Green & Mutala LLP

(57) ABSTRACT

A sound isolating ventilation panel is provided. The panel includes: a core assembly having a plurality of horizontal channels; a pair of cartridges having hollow centers and flanking both sides of the core assembly; and a pair of hollow sides flanking the pair of cartridges. Each of the cartridges has a proximally facing side having a plurality of air channel side apertures and a distally facing side comprising a plurality of sound resonator side apertures. A vertically oriented ventilation groove is formed through a front face of a first one of the cartridges and a vertically oriented ventilation groove is formed through a back face of the second one of the cartridges. The ventilation grooves, the hollow centers, the air channel side apertures and the horizontal channels together partially define Z-shaped air channels. The sound resonator side apertures and the hollow sides partially define a plurality of resonators.

17 Claims, 24 Drawing Sheets

(58) Field of Classification Search
USPC ..... 181/224
See application file for complete search history.

(56) References Cited

U.S. PATENT DOCUMENTS

| | | | | |
|---|---|---|---|---|
| 4,122,911 | A * | 10/1978 | Croup | H04R 1/021 381/345 |
| 4,842,097 | A | 6/1989 | Woodward et al. | |
| 5,424,497 | A | 6/1995 | Dias et al. | |
| 9,214,148 | B2 * | 12/2015 | Kato | G10K 11/002 |
| 9,534,385 | B2 * | 1/2017 | Burr | G10K 11/16 |
| 10,657,947 | B2 * | 5/2020 | Zalewski | G10K 11/168 |
| 2015/0267404 | A1 | 9/2015 | Yau et al. | |
| 2018/0066429 | A1 * | 3/2018 | Yau | E04C 2/523 |

FOREIGN PATENT DOCUMENTS

| | | | |
|---|---|---|---|
| JP | 2009084897 | A | 4/2009 |
| JP | 2009243078 | A | 10/2009 |
| JP | 2014025336 | A | 2/2014 |
| JP | 2020166024 | A | 10/2020 |
| WO | 2013190932 | A1 | 12/2013 |
| WO | 2015139123 | A1 | 9/2015 |

* cited by examiner

Single Side Ridges

Alternating Ridges

Z insert

SOUND ISOLATING VENTILATION PANELS AND METHODS FOR MANUFACTURING SAME

REFERENCE TO RELATED APPLICATIONS

This application is a national phase entry of Patent Cooperation Treaty Patent application No. PCT/CA2022/051067 filed 7 Jul. 2022, which claims priority to and the benefit of U.S. Provisional Patent Application No. 63/220,827 filed 12 Jul. 2021. The foregoing applications are hereby incorporated by reference herein in their entireties for all purposes.

TECHNICAL FIELD

This invention generally relates to sound isolating ventilation panels, such as doors, and methods for manufacturing same.

BACKGROUND

In commercial and institutional buildings, it is standard for all interior spaces to have dedicated fresh air supplies and returns/exhausts. Sometimes this air is conditioned (heated/cooled, moisture controlled). Depending on the building, floorplan, mechanical system, outdoor air enters a building and moves through ventilation equipment and ducts as well as occupied spaces and interior ventilation openings before being exhausted outside. Most commercial buildings use mechanical fans to move air through a system and building, though some employ natural forces like thermal buoyancy and wind pressure. Common air transfer openings between rooms in buildings include door undercuts (the gap between the bottom of a door and the floor), grilles, and transfer ducts. The capacity for airflow depends on the cross-sectional area, flow path shape, and obstructions in the flow path. Through a given ventilation opening or duct, the differential air pressure and rate of airflow are directly related (airflow is proportional to the square root of the pressure difference). Ventilation system engineers design systems to provide air to each space given its floor area and occupancy, with minimum limits prescribed by standardization agencies.

For a panel (e.g. a door) of a given size that partitions spaces and provides means for air transfer, it is generally desirable to maximize the capacity for airflow so as to increase the panel's application to spaces that require higher airflow rates.

When sound is incident upon a panel, components of the energy are reflected, absorbed, and transmitted by the panel. Sound transmission is quantified by the Transmission Coefficient, tao, the proportion of energy transmitted relative to the total incident sound energy, as well as Transmission Loss, the decibel reduction in sound levels across the panel. For a given panel, both quantities vary across the frequency spectrum.

Given a sound source on one side of a single homogenous panel, sound transmission loss through the panel is primarily defined by the panel's mass per unit area, which increases with frequency at 6 db/octave. In FIG. 1 (from L. L. Beranek (ed.), Noise Reduction, McGraw-Hill, New York, 1960), Region II shows the mass-controlled band. At frequencies below the mass-controlled band, Region I, resonances of the panel cause large variations in transmission loss.

Additionally, panel stiffness influences transmission loss, and bending waves propagate in the plane of the panel with wavelengths dependent on the bulk modulus and density of the panel. For sound incident on the panel at angles other 90 degrees, when the incident angle and wavelength combine for a trace wavelength along the panel equal to the panel's bending wavelength a sort of resonance occurs, and this is known as 'coincidence'. The coincidence effect allows more sound to transmit and spans bandwidths upwards from the 'critical frequency', $f_c$, where grazing incidence wavelengths begin to influence bending waves in the panel, as illustrated in Region III.

The primary strategy to increase the sound transmission loss (increasing sound isolation) of a single homogenous panel is increasing its mass, which translates the transmission loss of the mass-controlled band upwards. Additionally, two more strategies can also increase transmission loss: decreasing stiffness—moves the critical frequency and coincidence effect dip upwards along the frequency axis; adding internal damping—reduces the magnitude of panel resonance and coincidence dips in the transmission loss.

Two panels separated by an airspace, present another option for increasing sound isolation. At the lower end of the frequency spectrum, the airspace acts as a spring and acoustically couples the panels to act as a single panel. For frequencies above which the separation distance is equal to a quarter wavelength, the airspace acts to decouple the two panels and transmission loss increases at 18 db/octave. Dips in sound transmission due to coincidence effects are also present here for each of the two panels. The transmission loss can be further increased by adding a sound-absorptive material between the two panels. This further decouples the two panels by attenuating waves traveling between the panels and reducing standing waves.

Airborne sound can be absorbed through dissipative or reactive means. Dissipative sound absorbers, such as open cell porous materials, resist the organized molecular motion of sound energy, converting it into heat. Reactive sound absorbers employ mechanical or acoustical resonance to elevate particle velocity across tuned frequency bands, this presents the opportunity for sound energy in these frequency bands to be absorbed (converted to heat) through the combined use of dissipative materials or inherently through air absorption. The term 'baffle' generally refers to constructions that absorb sound through dissipative or reactive means (example: interior ceiling tiles), and constructions that block sound (example: highway noise barriers).

The embodiments described in U.S. Pat. No. 10,612,239 entitled "PANEL AND PANEL STRUCTURE FOR VENTILATION AND BOTH REACTIVE AND DISSIPATIVE SOUND DAMPENING" allow for passive air transfer between rooms by way of a Z-shaped air channel through the grooves on the front/back faces and hollow centre. Sound transmission across the panel and through the air channel is dissipated through sound absorptive baffles in the hollow centre and resonators on the periphery of the grooves.

Previously disclosed embodiments in U.S. Pat. No. 10,612,239 present challenges associated with manufacturability (and therefore cost) as well as sound transmission performance. Challenges include:

- requiring a large number of components between the top/bottom sheets (skins);
- using internal components that must be joined together (using dowels or floating tenons) in a frame before laminating to the top/bottom sheets (skins);
- using components that must be placed loosely without direct contact or registration to other internal components at assembly;

requiring ventilation grooves to be machined after assembly does not provide a means of limiting dust and shavings from entering the panel's air channel during machining;

using components that make the assembly non-reversable and requiring this to be tracked after assembly as the ventilation grooves need to be machined on certain sides requiring thick top/bottom skins to provide adequate structure at the groove edges;

limited applications due to only fair sound isolation performance;

limited applications due to only fair airflow capacity;

poor opportunity to apply surface finishes to the interior surfaces visible through the inlet and outlet ventilation grooves;

weight due to thick door skins, heavier than typical hollow interior doors, affecting transport and installation; and fracture/crack failure due to stress concentrations at rectangular resonator openings/necks.

Improved panels which address at least some of these challenges are desirable.

SUMMARY OF THE INVENTION

This invention has various aspects. These include, without limitation: sound isolating ventilation panel; methods for manufacturing sound isolating ventilation panels, and cartridges and core components useful in sound isolating ventilation panel.

In one aspect a sound isolating ventilation panel is provided. The panel includes: a core assembly comprising a plurality of horizontal channels; a pair of cartridges having hollow centers and flanking both sides of the core assembly; and a pair of hollow sides flanking the pair of cartridges. Each of the cartridges comprises a proximally facing side comprising a plurality of air channel side apertures and a distally facing side comprising a plurality of sound resonator side apertures. A vertically oriented ventilation groove is formed through a front face of a first one of the cartridges and a vertically oriented ventilation groove is formed through a back face of the second one of the cartridges. The ventilation grooves, the hollow centers, the air channel side apertures and the horizontal channels together partially define Z-shaped air channels. The sound resonator side apertures and the hollow sides partially define a plurality of resonators.

The frame may comprise a top rail, a bottom rail and two stiles, wherein the pair of cartridges may be disposed between the top rail and bottom rail, and wherein the top rail, the bottom rail, the two stiles and the distally facing sides may partially define the hollow sides.

The frame may comprise a front skin and a back skin, wherein the frame, core assembly and the pair of cartridges may be supportively disposed between the front skin and the back skin. The vertically oriented ventilation groove formed through the front face of the first one of the cartridges may also be formed through the front skin, and the vertically oriented ventilation groove formed through the back face of the second one of the cartridges may also be formed through the back skin.

Each of the cartridges may have a horizontal plane of symmetry and a vertical plane of symmetry.

Each of the plurality of air channel side apertures may align with a corresponding one of the plurality of horizontal channels.

The plurality of air channel side apertures may be identical and equidistantly spaced, and the plurality of sound resonator side apertures may be identical and equidistantly spaced.

The plurality of air channel side apertures may be larger than and fewer in number than the plurality of sound resonator side apertures.

The plurality of air channel side apertures may be arranged linearly in series, and wherein the plurality of sound resonator side apertures may be arranged linearly in series.

Each space between the air channel side apertures may be at least one inch.

Each of the cartridges may extend at least 80%, or at least 90% of a height of the panel.

The horizontal channels may be at least partially formed from folded corrugated fiberboard.

Interior surfaces of the horizontal channels may comprise sound absorbing linings of a porous, dissipative material such as open cell foam, mineral wool or fiberglass.

The core assembly may occupy substantially all of the space between the pair of cartridges.

The core assembly may comprise 6 to 24 adjacently arranged horizontal channels.

Walls between adjacent horizontal channels may comprise a plurality of apertures to increase exposed surface area of sound absorbing linings.

The hollow sides may comprise porous, dissipative sound absorbing material.

Another aspect provides a method of manufacturing a sound isolating ventilation panel comprising:

a. providing a frame comprising a top rail, a bottom rail and two stiles;

b. providing a core assembly comprising a plurality of horizontal channels;

c. providing a pair of cartridges comprising hollow centers, the cartridges positioned between the top rail and the bottom rail and flanking both sides of the core assembly, wherein each of the cartridges comprises a proximally facing side comprising a plurality of air channel side apertures aligned with the plurality of horizontal channels, and a distally facing side comprising a plurality of sound resonator side apertures;

d. providing a front skin and a back skin, whereby the sound resonator side apertures and a space between the stiles, the distally facing side and the front and back skins define resonators;

e. forming a vertically oriented ventilation groove through the front skin and a front face of a first one of the cartridges, and forming a vertically oriented ventilation groove through the back skin and a back face of the second one of the cartridges, whereby the ventilation grooves, the hollow centers, the air channel side apertures and the horizontal channels together define Z-shaped air channels.

Step c. may further comprise inserting an insert into each of the cartridges, wherein the insert comprises blocking portions and receiving portions, the blocking portions for substantially blocking off the air channel side apertures and sound resonator side apertures from the receiving portions which are configured to receive dust and debris generated by step e. regardless of whether the vertically oriented ventilation grooves are formed in the front or back of the cartridge, and wherein after step e. the insert is removed from the cartridges through the vertically oriented ventilation grooves.

Prior to step c. the proximally facing side and the distally facing side may be manufactured by: (i) making cuts in a rectangular block having the length of the cartridges, (ii) stacking the cut blocks, and (iii) boring air channel side apertures or sound resonator side apertures through the stacked blocks.

Prior to step c. the proximally facing side and the distally facing side may be manufactured by: (i) boring slots sized to the air channel side apertures or the sound resonator side apertures through an elongated rectangular block having the length of the cartridges; (ii) making joinery profile cuts in the bored elongated rectangular block, (iii) ripping the profiled and bored elongated block into individual proximally facing sides or distally facing sides.

Prior to step c. the proximally facing side and the distally facing side may be manufactured by: (i) providing two sheets each having the length of the cartridges; sandwiching spaced apart ribs between the sheets, the spacing of the ribs matching the dimensions of the air channel side apertures or the sound resonator side apertures; and (ii) cutting the sheets into strips of the proximally facing sides or the distally facing sides.

Prior to step c. the cartridges may be manufactured by: (i) gluing the proximally facing side, the distally facing side, and two backers together to form a cartridge; (ii) stacking a plurality of cartridges from step (i); and (iii) pressing against the stack of cartridges in vertical and/or horizontal directions.

Another aspect provides a cartridge for a sound isolating ventilation panel, the cartridge comprising:

- a hollow center;
- a front face;
- a back face opposite the front face;
- a proximally facing side comprising a plurality of air channel side apertures;
- a distally facing side comprising a plurality of sound resonator side apertures; and a vertically oriented ventilation groove is formed through the front face or the back face.

The cartridge may comprise a horizontal plane of symmetry and a vertical plane of symmetry.

The plurality of air channel side apertures may be identical and equidistantly spaced, and the plurality of sound resonator side apertures may be identical and equidistantly spaced.

The plurality of air channel side apertures may be larger than and fewer in number than the plurality of sound resonator side apertures.

The plurality of air channel side apertures may be arranged linearly in series, and wherein the plurality of sound resonator side apertures may be arranged linearly in series.

Each space between the air channel side apertures may be at least one inch.

Another aspect provides a core component for a sound isolating ventilation panel, the core component comprising a single corrugated fiberboard sheet folded to define two channels having rectangular cross sections.

The sheet may comprise a plurality of linearly arranged slots at a mid portion of the sheet and corresponding plurality of tabs at an end of the sheet for engaging the slots to facilitate forming at least one of the channels.

The two channels may be equally sized.

It is emphasized that the invention relates to all combinations of the above features, with one another and/or with other features that are described elsewhere herein and/or depicted in the drawings even if these are recited in different claims, different paragraphs and/or different sentences.

In addition to the exemplary aspects and embodiments described above, further aspects and embodiments will become apparent by reference to the drawings and by study of the following detailed descriptions.

BRIEF DESCRIPTION OF DRAWINGS

The accompanying drawings illustrate non-limiting example embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

FIGS. 2A-2D, 3A-3C, 6A, 6B, 14A-C, 15A, 15B, 21B, 21C and 22A-D show a sound isolating ventilation panel 100 and components thereof according to an embodiment.

Panel

Figure 2A:
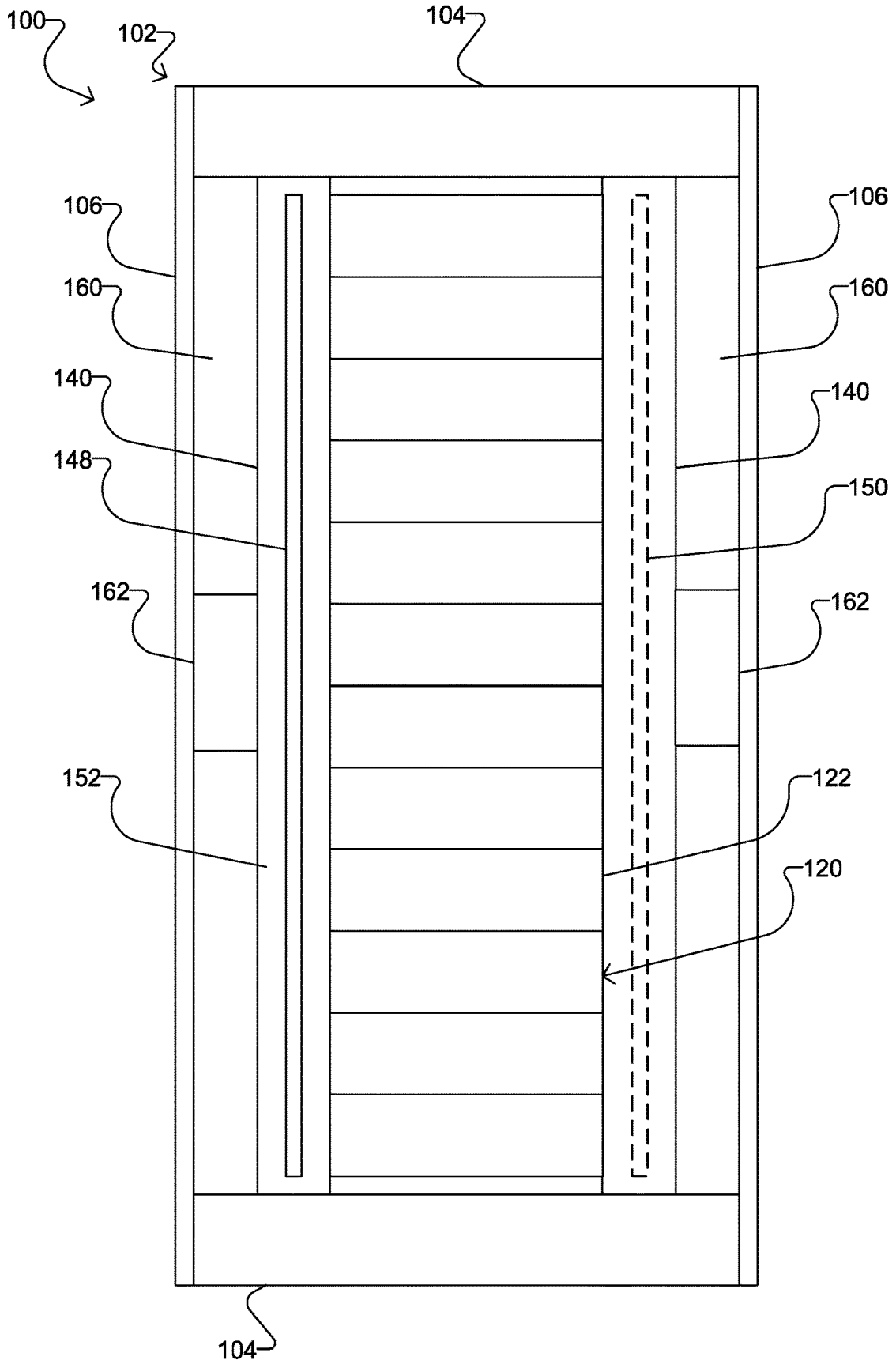
FIG. 2A is a front view of a panel according to an embodiment, wherein the top skin has been removed to show internal components.
Figure 2B:
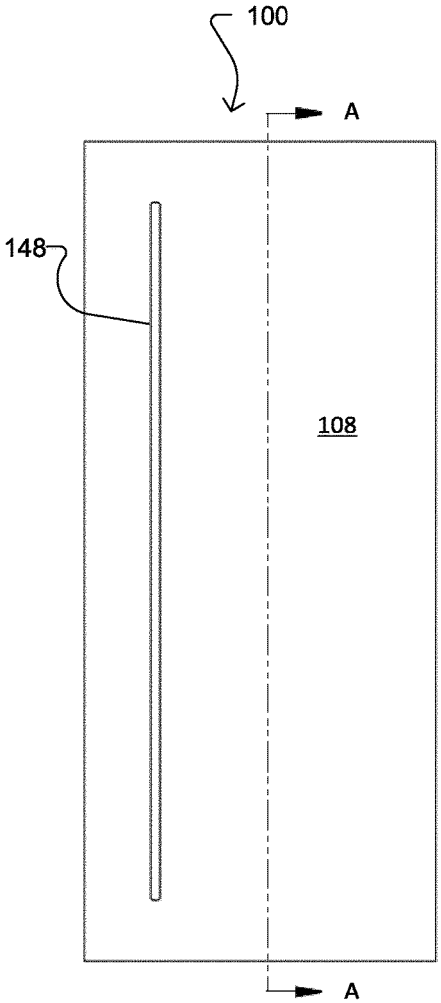
FIG. 2B is a front view of a panel according to the embodiment shown in FIG. 2A.
Figure 2C:
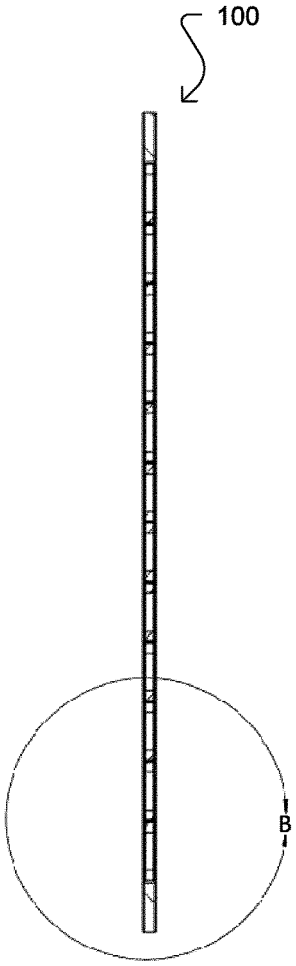
FIG. 2C is a vertical cross-sectional view taken along plane A-A of FIG. 2A.
Figure 2D:
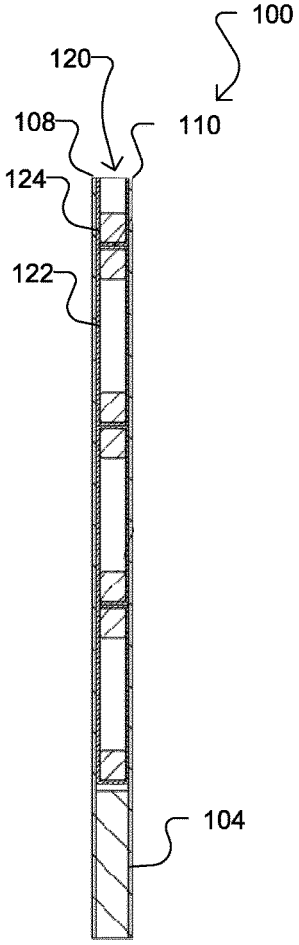
FIG. 2D is a close up detail B of FIG. 2B.
Figure 3A:
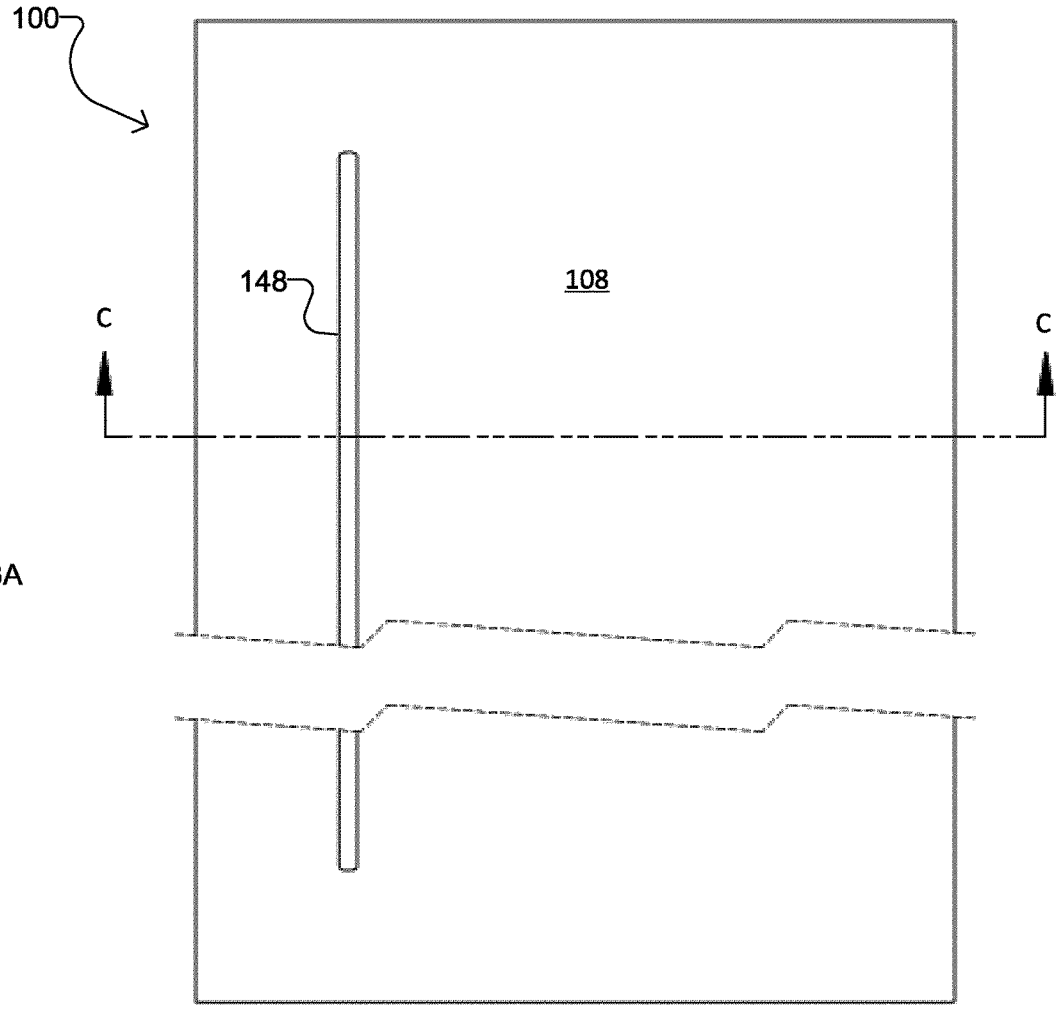
FIG. 3A is a partial front view of a panel according to the embodiment shown in FIG. 2A.
Figure 3B:
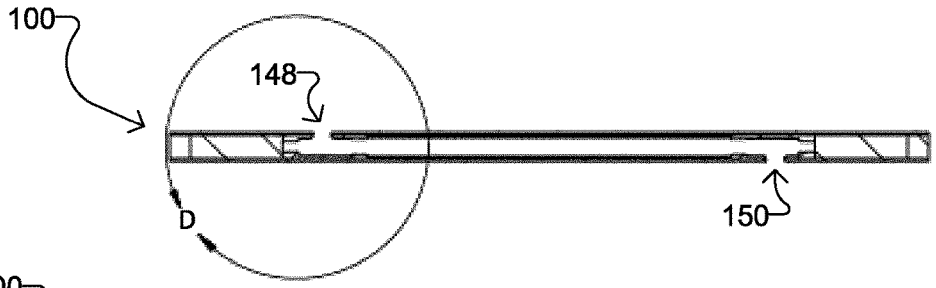
FIG. 3B is a horizontal cross-sectional view taken along plane C-C of FIG. 3A.
Figure 3C:
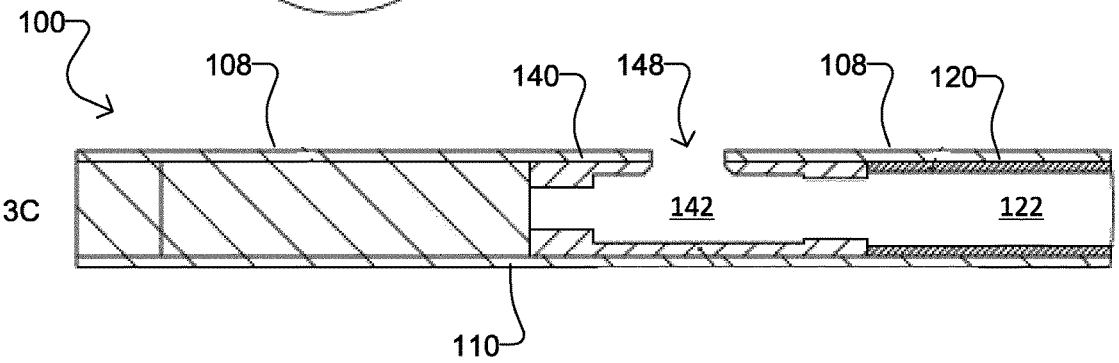
FIG. 3C is a close up detail D of FIG. 3B.
Figure 4A:
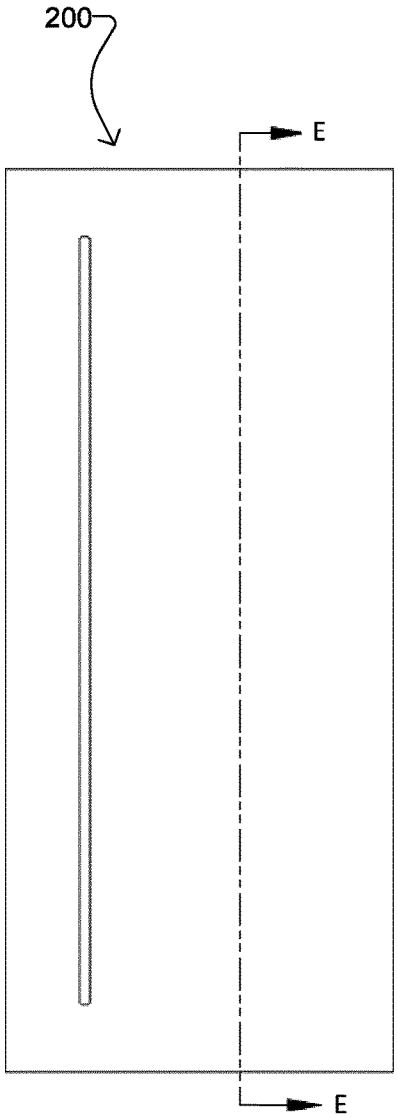
FIG. 4A is a front view of a panel according to an embodiment.
Figure 4B:
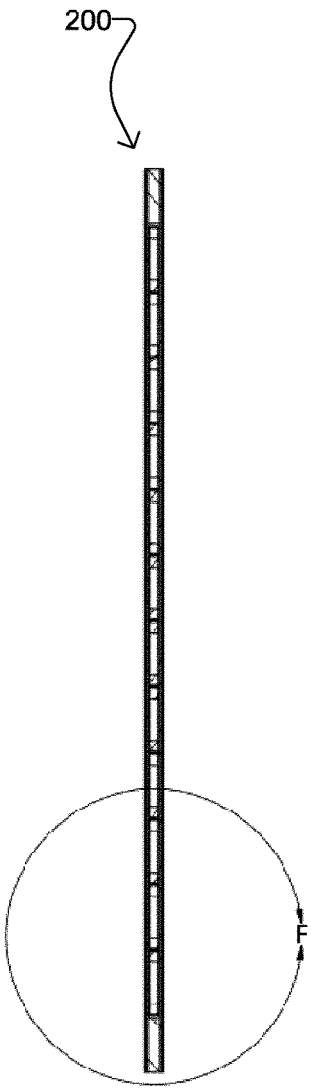
FIG. 4B is a vertical cross-sectional view taken along plane E-E of FIG. 4A.
Figure 4C:
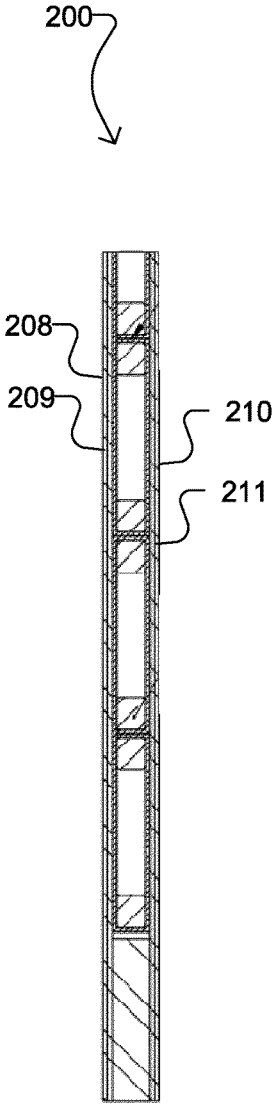
FIG. 4C is a close up detail F of FIG. 4B.
Figure 5A:
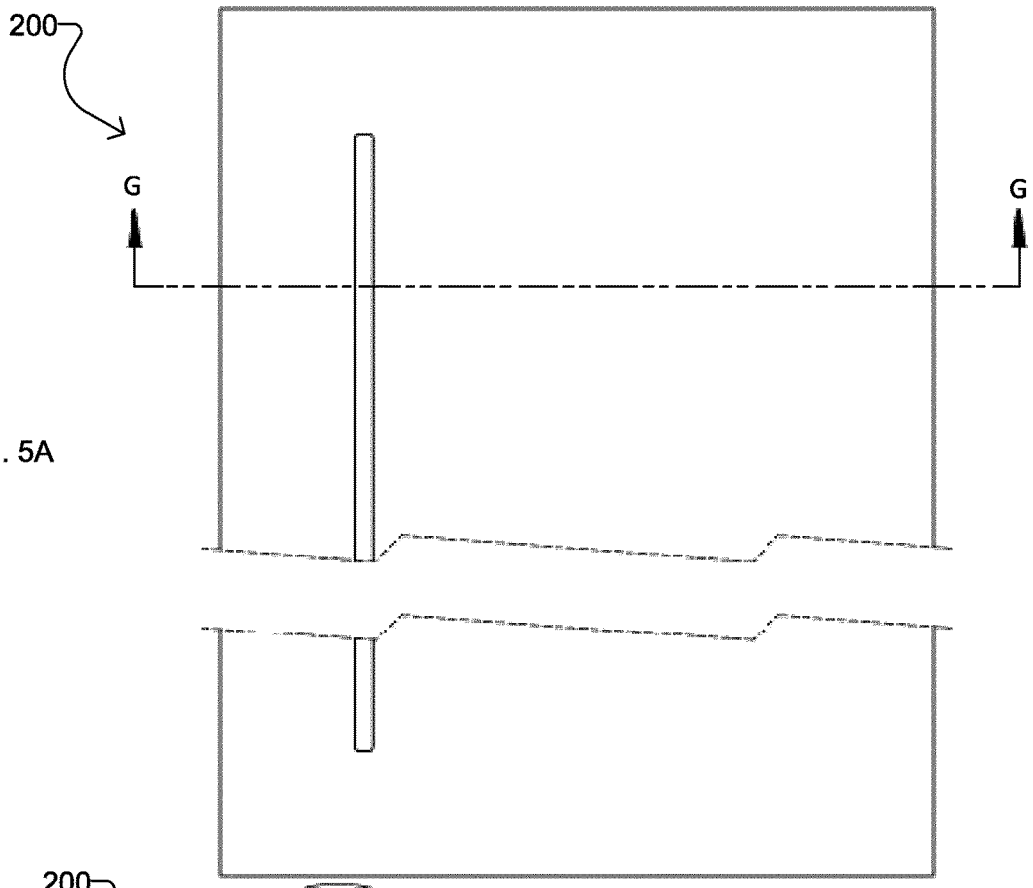
FIG. 5A is a partial front view of a panel according to the embodiment shown in FIG. 4A.
Figure 5B:
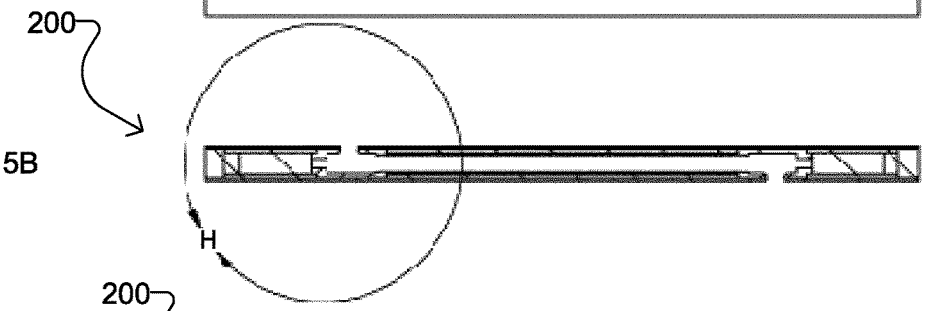
FIG. 5B is a horizontal cross-sectional view taken along plane G-G of FIG. 5A.
Figure 5C:
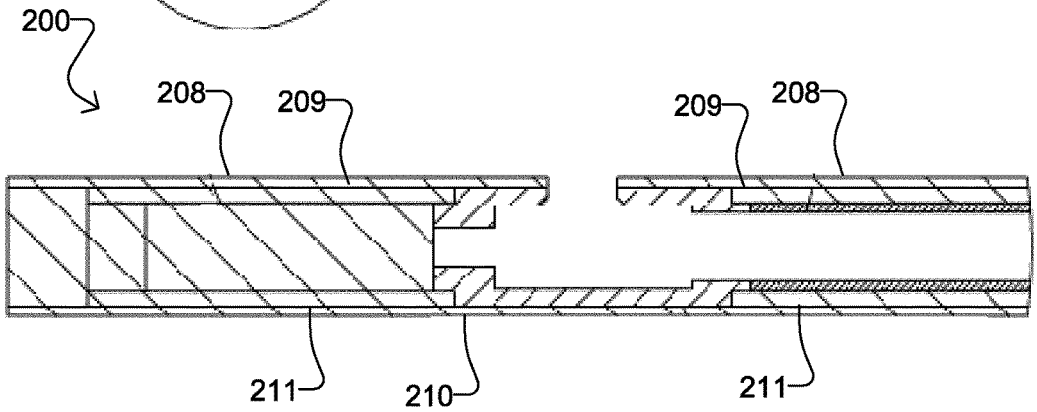
FIG. 5C is a close up detail H of FIG. 5B.

As shown in FIG. 2A, panel 100 has a rectangular frame 102 consisting of horizontal upper and lower rails 104 and vertical side stiles 106. Frame 102 surrounds a core assembly 120 occupying the center of frame 102. Core assembly 120 is flanked on either side by a pair of cartridges 140. Resonators 160 define the space between cartridges 140 and stiles 106. Hardware blocks 162 occupy the space between cartridges 140 and stiles 106 as well as resonators 160.

FIG. 2A shows panel 100 without front skin 108 and back skin 110. FIGS. 2A to 3C show panel 100 with front skin 108 and back skin 110 sandwiching frame 102, core assembly 120 and cartridges 140. FIG. 4A to 5C show a panel 200 according to another embodiment with an intermediate front layer 209 under front skin 208, and an intermediate back layer 211 under back skin 210. Panel 200 has intermediate layers 209 and 211 due to its additional thickness compared to panel 100. For example, panel 100 may be a 1.375 inch panel and panel 200 may be 1.75 inch panel.

Methods of manufacturing a sound isolating ventilation panel such as panels 100, 200 are also provided. Steps include: (a) providing a frame comprising a top rail, a bottom rail and two stiles; (b) providing a core assembly comprising a plurality of horizontal channels; (c) providing a pair of cartridges comprising hollow centers, the cartridges positioned between the top rail and the bottom rail and flanking both sides of the core assembly, wherein each of the cartridges comprises a proximally facing side comprising a plurality of air channel side apertures aligned with the plurality of horizontal channels, and a distally facing side comprising a plurality of sound resonator side apertures; (d) providing a front skin and a back skin, whereby space between the stiles, the distally facing side and the front and back skins (the resonator cavities) as well as the sound resonator side apertures define resonators; (e) forming a vertically oriented ventilation groove through the front skin and a front face of a first one of the cartridges, and forming a vertically oriented ventilation groove through the back skin and a back face of the second one of the cartridges, whereby the ventilation grooves, the hollow centers, the air channel side apertures and the horizontal channels together define Z-shaped air channels.

Figure 21A:
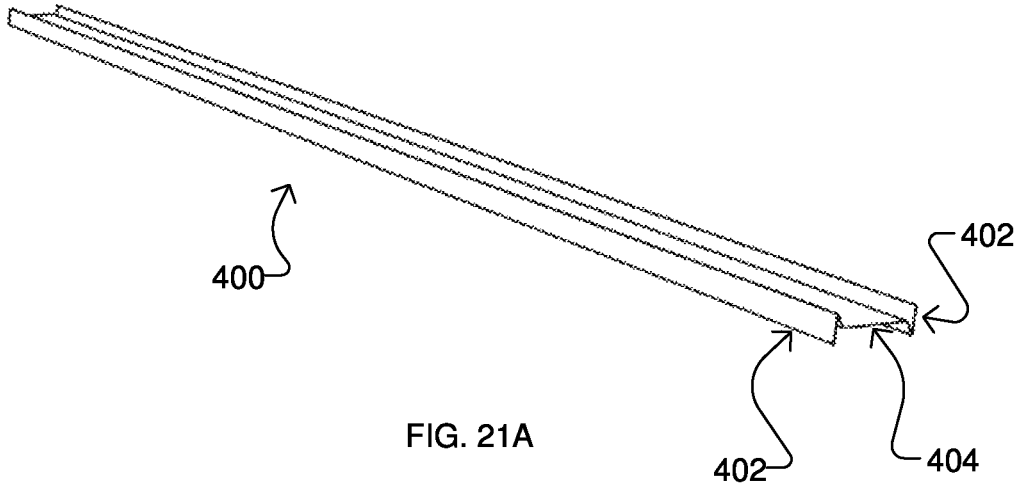
FIG. 21A is a perspective view of a dust blocking insert according to an embodiment of the invention.
Figure 21B:
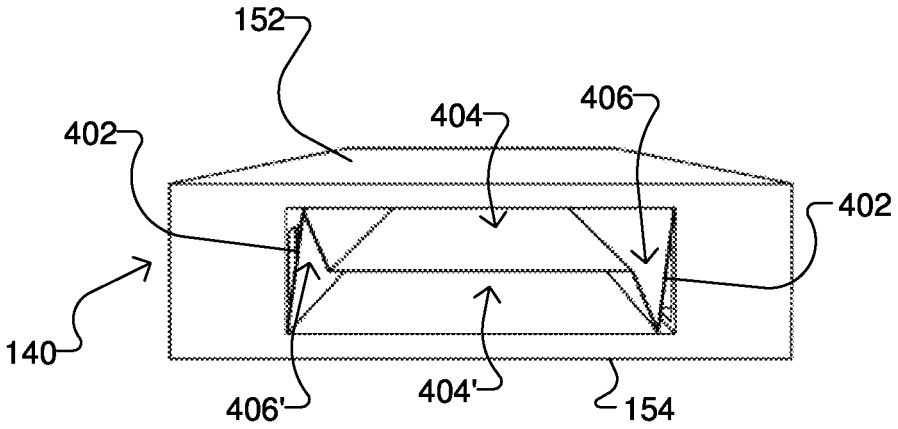
FIG. 21B is a horizontal cross-sectional view of the dust blocking insert shown in FIG. 21A inside a cartridge of a panel according to the embodiment shown in FIG. 2A.
Figure 21C:
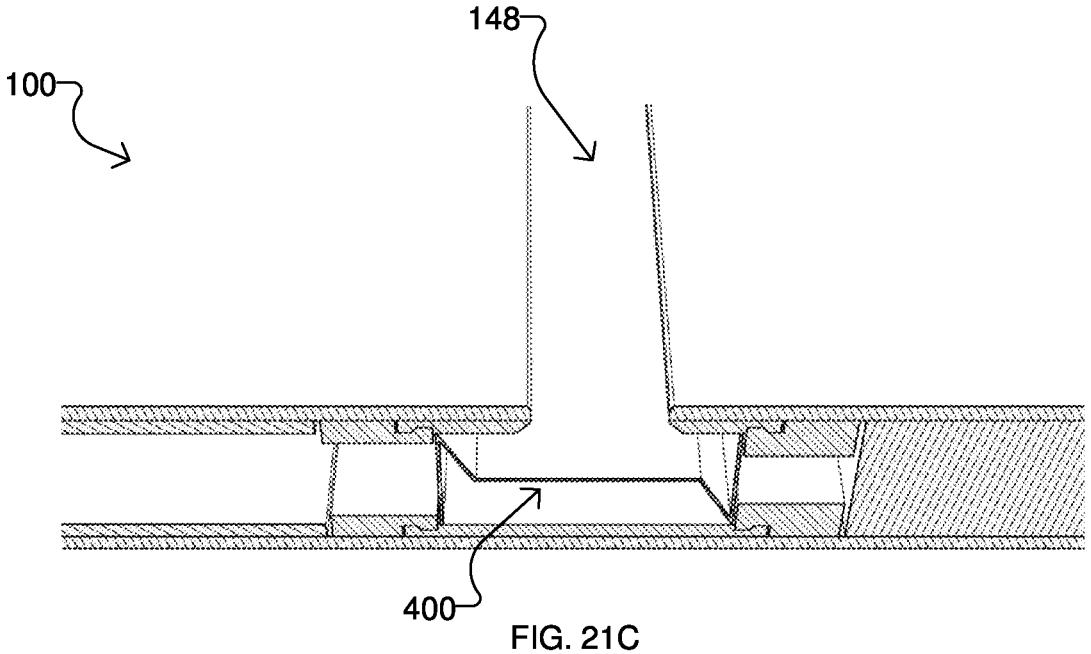
FIG. 21C is a horizontal cross-section of the dust blocking insert shown in FIG. 21A inside a cartridge of a panel according to the embodiment shown in FIG. 2A.
Figure 22A:
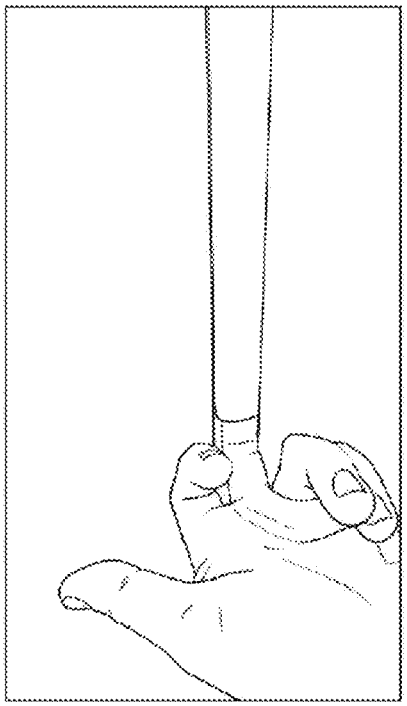
FIGS. 22A to 22D show the steps for removal of the dust blocking insert shown in FIG. 21A inside a cartridge of a panel according to the embodiment shown in FIG. 2A.
Figure 22B:
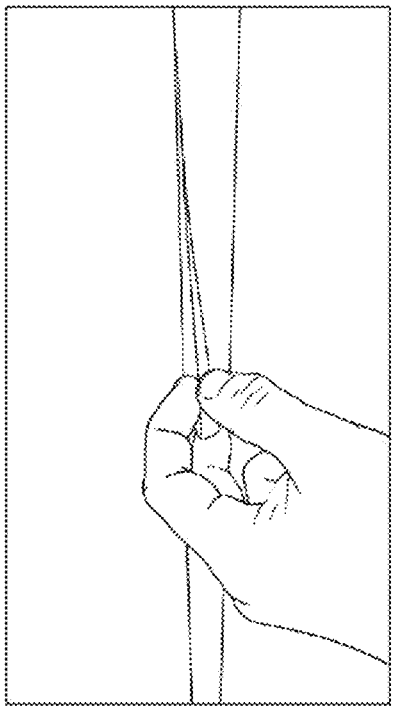
Figure 22C:
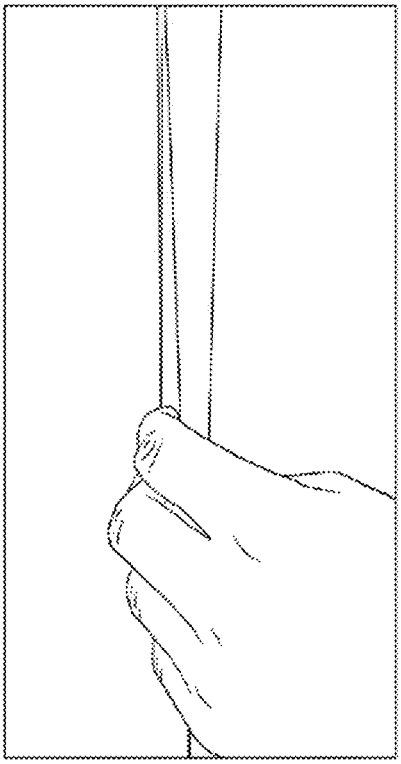
Figure 22D:
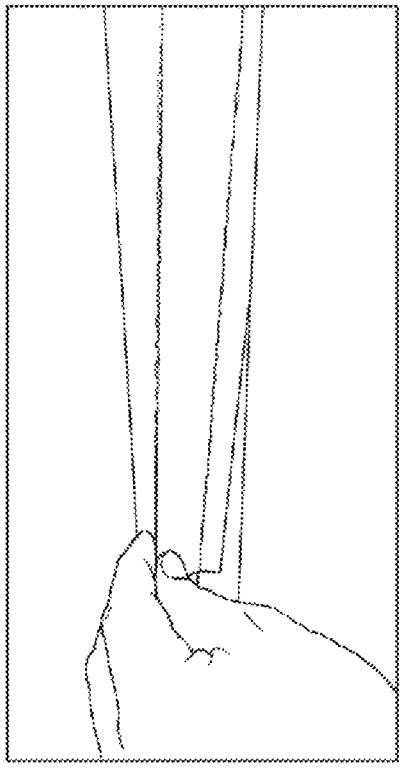

As shown in FIGS. 21A to 21C, in some embodiments step e. includes inserting dust blocking insert 400 into the cartridges for preventing dust and debris from infiltrating the panel during formation of the ventilation grooves. Insert 400 has blocking portions 402, receiving portions 404 and receiving grooves 406. Blocking portions 402 substantially block off air channel side apertures and sound resonator side apertures from receiving portions 404 and receiving grooves 406, which in turn are shaped to catch and collect dust and debris generated by step e., that is, the ventilation groove forming step. The shape of insert 400 is configured to be the same regardless of front side and back side, so dust and debris is caught and prevented from entering the air channel side apertures and sound resonator side apertures regardless of whether the vertically oriented ventilation grooves are formed in the front face or back face of the cartridge. After step e. insert 400 can be pulled out of the cartridges through the vertically oriented ventilation grooves as shown in FIGS. 22A to 22D.

Figure 1:
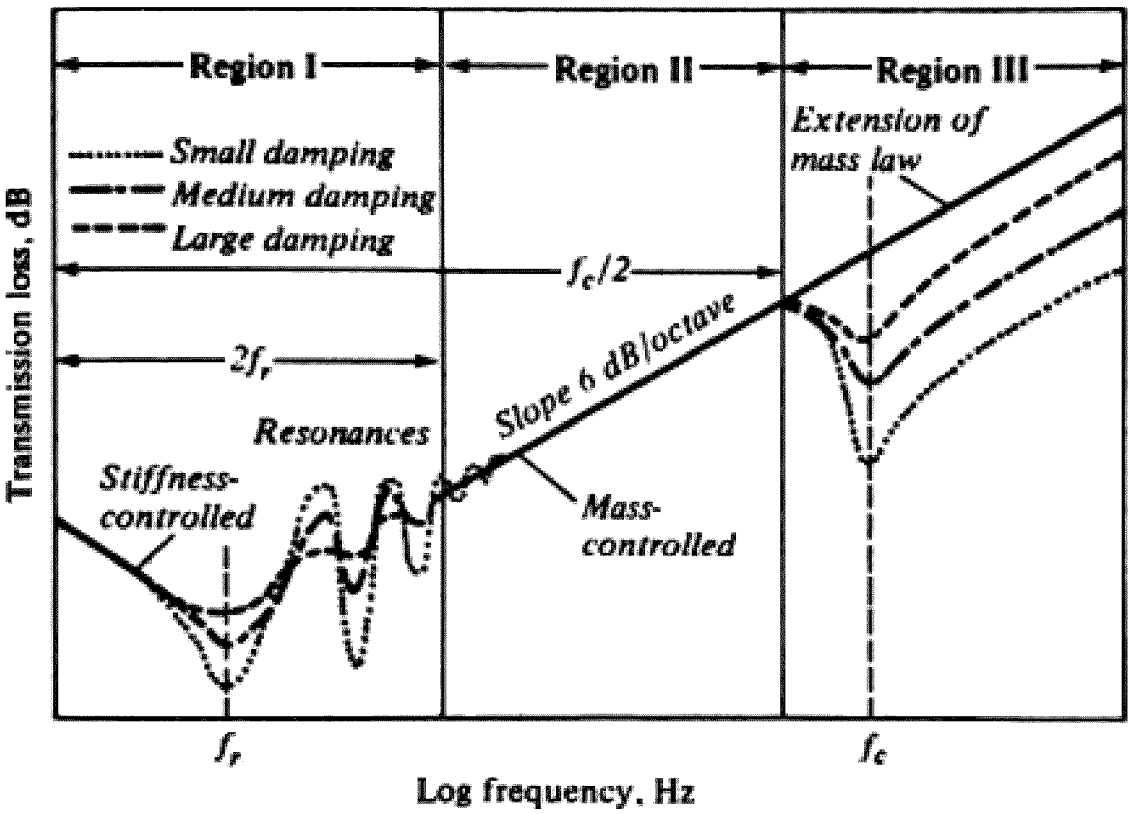
FIG. 1 PRIOR ART
FIG. 1 is a chart showing theoretical transmission loss of a homogeneous infinite panel.

Compared for example to the embodiments described in U.S. Pat. No. 10,612,239, the present methods employ fewer total components, and fewer components at the layup stage, resulting in faster assembly for each door, and more doors in each stack, increasing manufacturing throughput. Furthermore, the components of the panels described herein are amenable to being sized for simple and accurate placement and alignment at assembly, since the combined surface area of the components occupy most of the panel's total surface area (e.g. see FIG. 1), and since each component is placed flush or in contact with surrounding components (e.g. core elements are connected to form a substantially unitary core assembly, the core assembly is sandwiched between the cartridges, the cartridges are sandwiched between the rails, etc.), further increasing ease and speed of assembly.

Cartridge

Figure 6A:
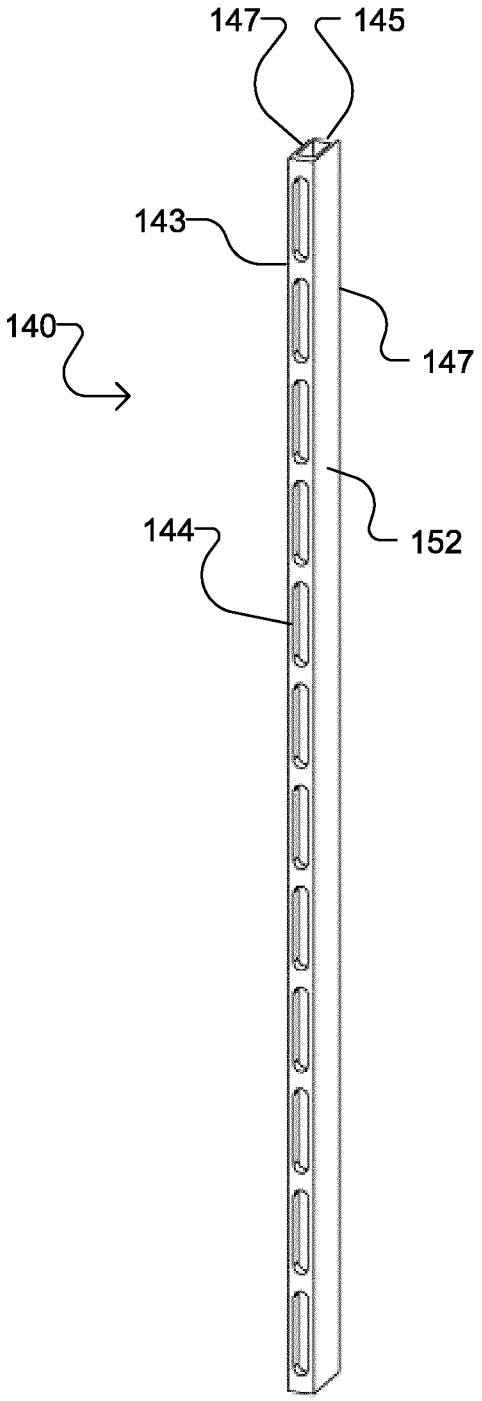
FIG. 6A is a perspective view of the air channel side of a cartridge of a panel according to the embodiment shown in FIG. 2A.
Figure 6B:
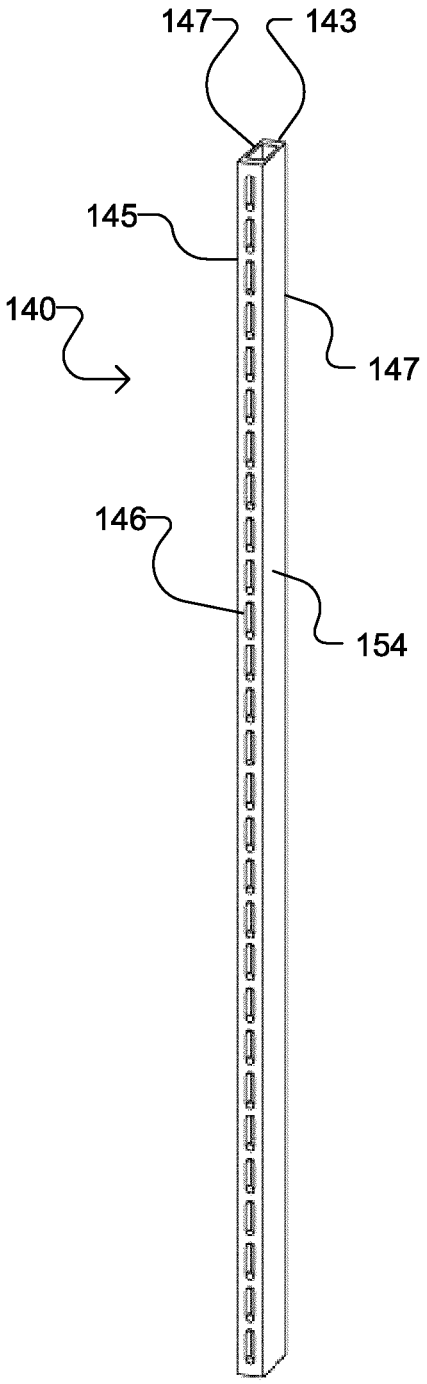
FIG. 6B is a perspective view of the sound resonator side of a cartridge of a panel according to the embodiment shown in FIG. 2A.
Figure 7A:
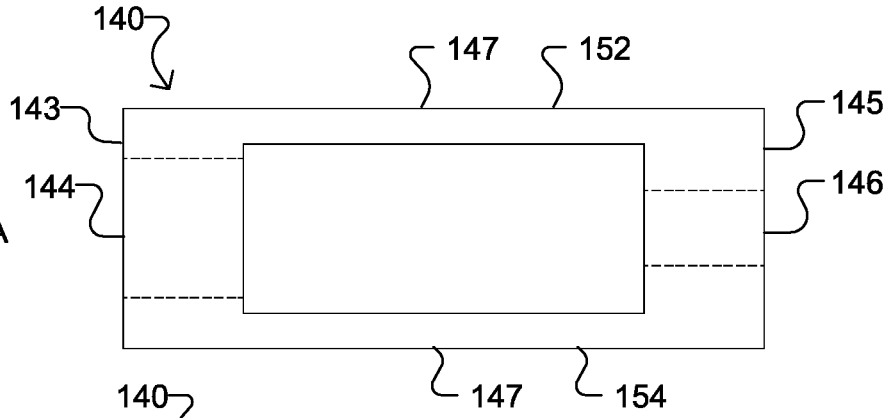
FIGS. 7A to 7D are horizontal cross-sectional views of cartridges according to embodiments of the invention.
Figure 7B:
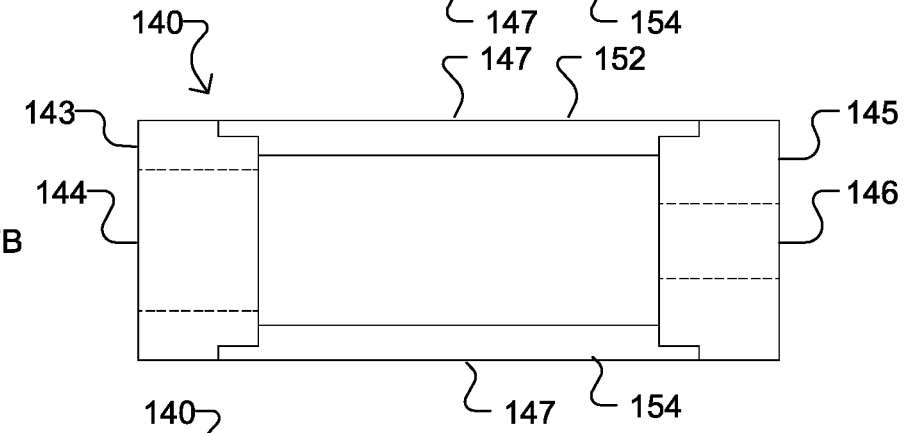
Figure 7C:
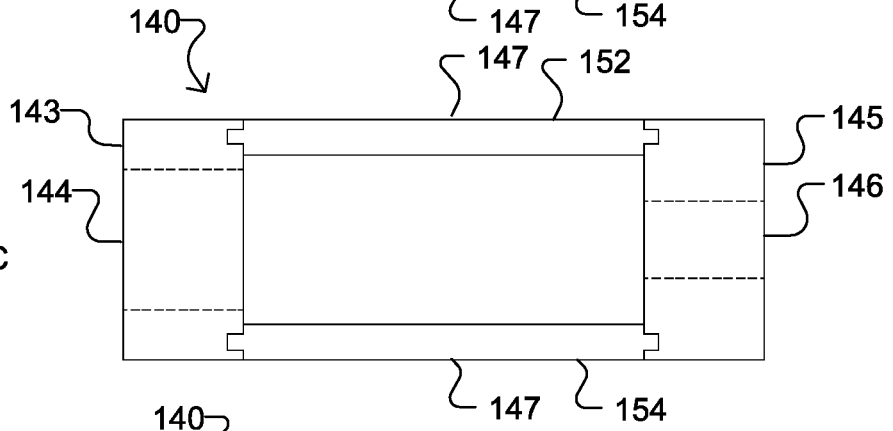
Figure 7D:
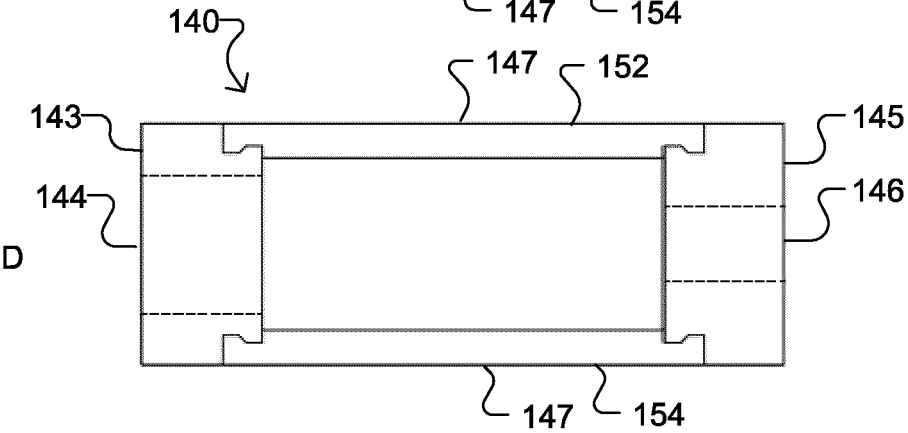
Figure 8A:
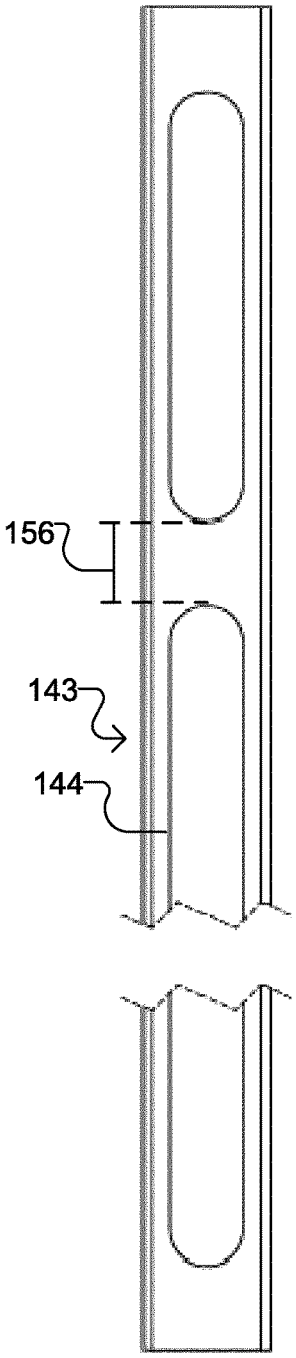
FIG. 8A is partial side view of a proximally facing side of a cartridge of a panel according to the embodiment shown in FIG. 2A.
Figure 8B:
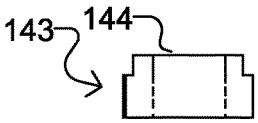
FIG. 8B is horizontal cross-sectional view of a proximally facing side of a cartridge of a panel according to the embodiment shown in FIG. 2A.
Figure 9A:
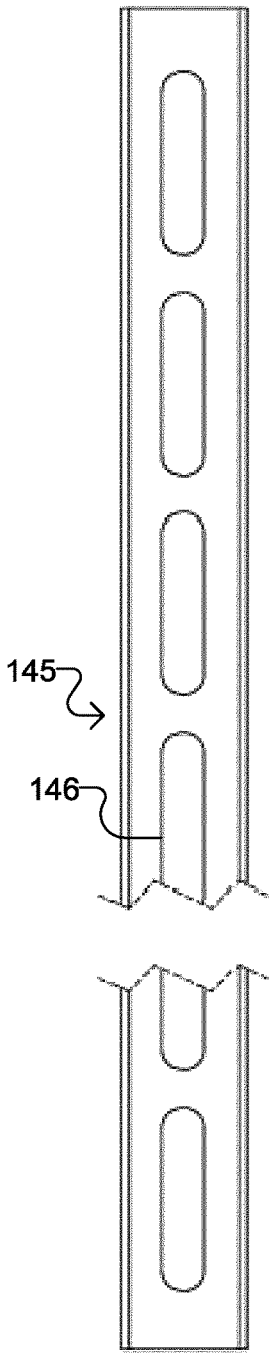
FIG. 9A is partial side view of a distally facing side of a cartridge of a panel according to the embodiment shown in FIG. 2A.
Figure 9B:
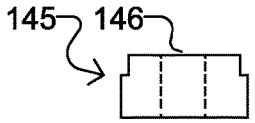
FIG. 9B is horizontal cross-sectional view of a distally facing side of a cartridge of a panel according to the embodiment shown in FIG. 2A.
Figure 10A:
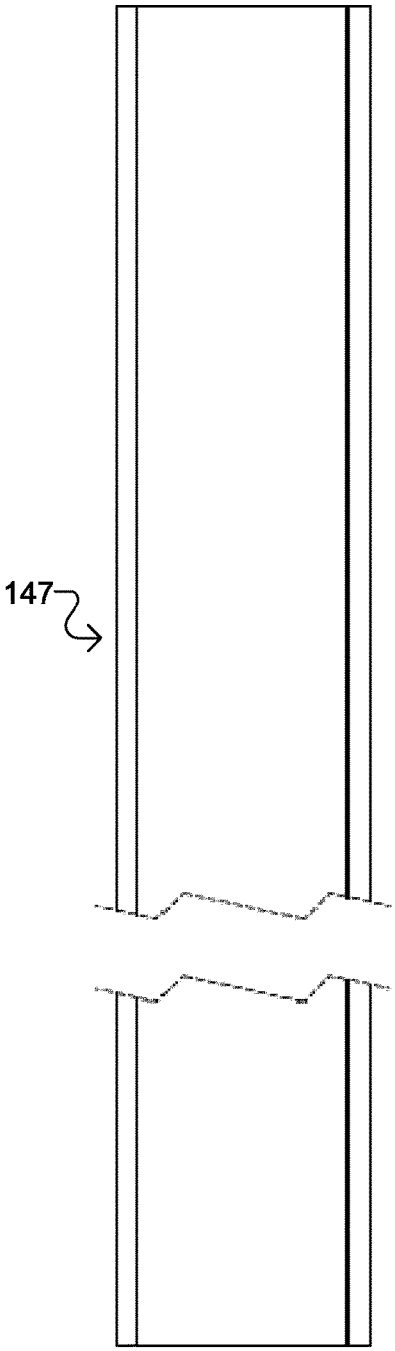
FIG. 10A is partial front view of backer of a cartridge of a panel according to the embodiment shown in FIG. 2A.
Figure 10B:
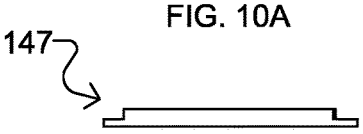
FIG. 10B is horizontal cross-sectional view of a backer of a cartridge of a panel according to the embodiment shown in FIG. 2A.

Cartridges 140 are elongated, as shown in FIGS. 2A, 6A and 6B, and have a generally rectangular cross section with hollow centers 142, as shown in FIGS. 7A to 7D. Each cartridge 140 has a proximally facing side 143 with a plurality of air channel side apertures 144, and a distally facing side 145 with a plurality of sound resonator side apertures 146. Bridging proximally facing side 143 and distally facing side 145 are two backers 147 with a respective front face 152 and a back face 154. FIG. 7A shows a cross section of cartridge 140 without showing the side to backer joinery. FIGS. 7B to 7D respectively show rebate joinery, tongue and groove joinery and draw lock joinery.

Air channel side apertures 144 align with and connect to corresponding horizontal channels 122 to provide uninterrupted air flow therethrough. Air channel side apertures 144 are identical and equidistantly and linearly arranged in series. In some embodiments, space 156 between air channel side apertures 144 is at least one inch to provide sufficient structural support and stiffness to panel 100. In some embodiments air channel side apertures 144 are of different sizes and/or not spaced equidistantly.

Sound resonator side apertures 146, resonators 160, and skins 108, 110 define Hemholtz resonators of panel 100. Sound resonator side apertures 146 are identical and equidistantly and linearly arranged in series. Sound resonator side apertures 146 are smaller and more numerous than air channel side apertures 144. In some embodiments, the resonator can be tuned to absorb varying sound levels across varying frequency bands by varying the size, shape, and spacing of sound resonator side apertures 146, the thickness of the distally facing side 145 (i.e., the neck length of the resonator), the volume of resonator 160 between stile 106 and cartridge 140, as well as the addition of a quantity of and placement of sound absorptive material in resonator 160. In some embodiments sound resonator side apertures 146 are of different sizes and/or not spaced equidistantly.

A vertically oriented front ventilation groove 148 is formed through front skin 108, and front face 152 of a first one of cartridges 140, and a vertically oriented back ventilation groove 150 is formed through back skin 110, and a back face 154 of a second one of cartridges 140. Ventilation grooves 148, 150, hollow centers 142 and air channel side apertures 144 of cartridge 140, and horizontal channels 122 of core assembly 120, together define Z-shaped air channels through panel 100. Cartridge 140 provides structural support (tensile/compressive stiffness and strength) to skins 108, 110 around the perimeter of ventilation grooves 148, 150. The added thickness and stiffness provided by cartridge 140 when bonded to skins 108, 110 mitigates warping at the edges of ventilation grooves 148,150.

Since the interior of cartridges 140 form the visible interior surfaces of panel 100, in some embodiments cartridges 140 may be constructed of higher quality materials (e.g. plywood) with surfaces suitable for being pre-finished before cartridge 140 is assembled. Finishes can include primer, paint, clear coat, veneer and plastic laminate. These finishes can also be applied to the cut surfaces of cartridge 140 after ventilation grooves 148, 150 are formed.

As best shown in FIGS. 6A and 6B, cartridge 140 has both a horizontal plane of symmetry and a vertical plane of symmetry, allowing vertically oriented ventilation grooves 148, 150 to be formed on either face 152, 154. In other words, vertically oriented ventilation grooves 148, 150 are reversible and there is no possibility of vertically oriented ventilation grooves 148, 150 being mistakenly formed on the wrong face of the cartridge.

In some embodiments, each of cartridges 140 extend at least 70%, at least 80%, or at least 90% of a height of panel 100.

Figure 11A:
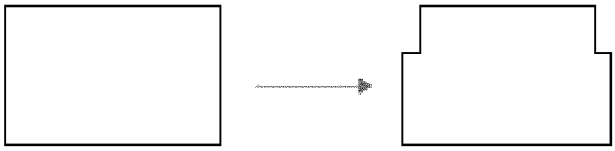
FIGS. 11A and 11B show a rebate cut step and slot bore step, respectively, of forming a proximally facing side and distally facing side as part of a method of manufacturing a panel according to an embodiment.
Figure 11B:
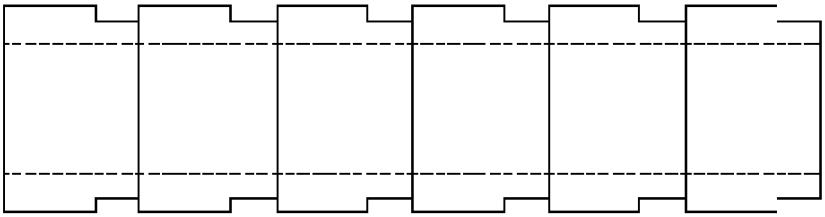

Methods of manufacturing cartridges such as cartridge 140 are also provided. As shown in FIGS. 11A and 11B, in some embodiments prior to step c. of the method of manufacturing panels, the proximally facing side and the distally facing side of the cartridges may be manufactured by: (i) making rebate cuts in a rectangular block having the length of the cartridges, (ii) stacking the rebate cut blocks, and (iii) boring air channel side apertures or sound resonator side apertures through the stacked blocks.

Figure 11C:
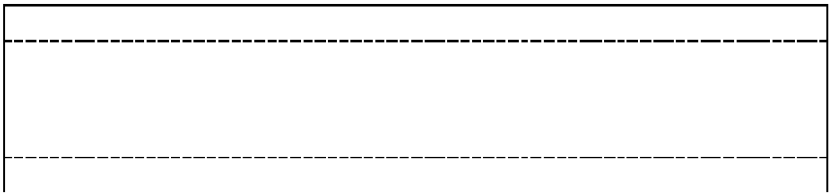
FIG. 11C to 11E, and FIGS. 11F to 11H, show a slot bore step, a joinery profile step, and a ripping step, respectively, of forming proximally facing sides and distally facing sides of a cartridge as part of a method of manufacturing a panel according to embodiments.
Figure 11D:
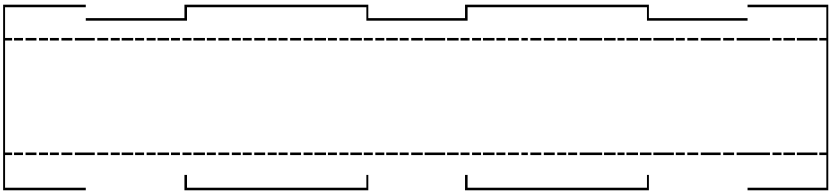
Figure 11E:
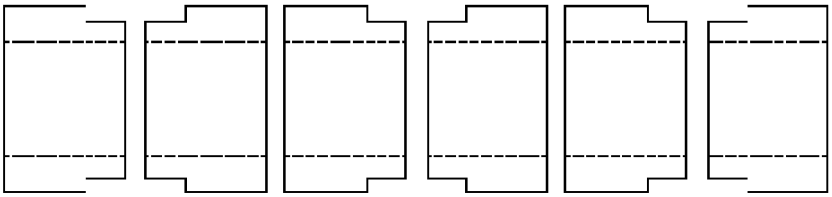
Figure 11F:
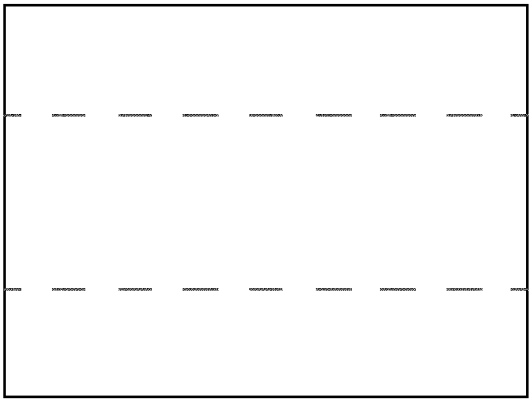
Figure 11G:
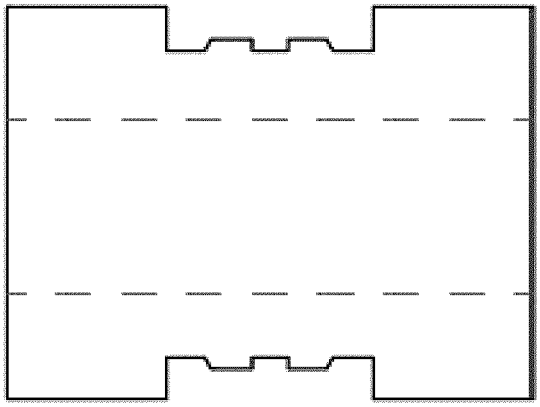
Figure 11H:
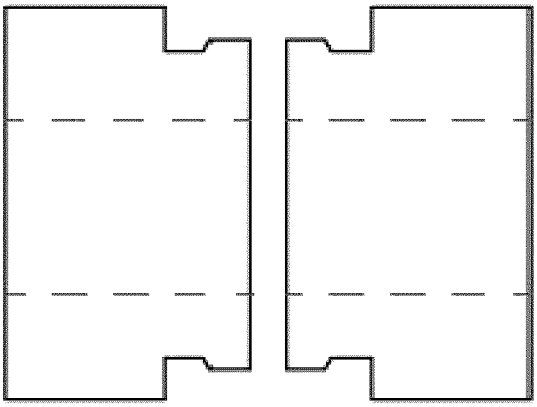

As shown in FIGS. 11C to 11E (for rebate joinery) and in FIGS. 11F to 11H (for drawer lock joinery), in some embodiments prior to step c. of the method of manufacturing panels the proximally facing side and the distally facing side of the cartridges may be manufactured by: (i) boring a hole sized to the air channel side apertures or the sound resonator side apertures through an elongated rectangular block having the length of the cartridges; (ii) making joinery profile cuts in the bored elongated rectangular block, (iii) ripping the profiled and bored elongated block into individual proximally facing sides or distally facing sides.

Figure 12A:
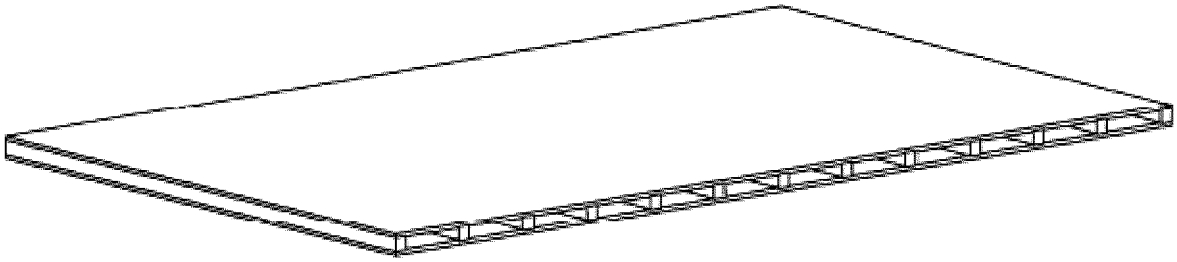
FIG. 12A is a perspective view of a laid up sheet for forming proximally facing sides and distally facing sides of a cartridge as part of a method of manufacturing a panel according to an embodiment.
Figure 12B:
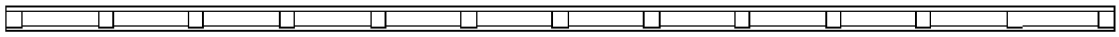
FIG. 12B is a side view of the laid up sheet shown in FIG. 12A.
Figure 12C:
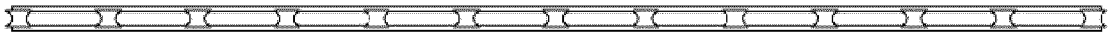
FIG. 12C is a side view of a laid up sheet for forming proximally facing sides and distally facing sides of a cartridge as part of a method of manufacturing a panel according to an embodiment.

As shown in FIGS. 12A to 12C, in some embodiments prior to step c. of the method of manufacturing panels the proximally facing side and the distally facing side of the cartridges may be manufactured by: (i) providing two sheets each having the length of the cartridges; sandwiching spaced apart ribs between the sheets, the spacing of the ribs matching the dimensions of the air channel side apertures or the sound resonator side apertures; and (ii) cutting the sheets into strips of the proximally facing sides or the distally facing sides.

Figure 13A:
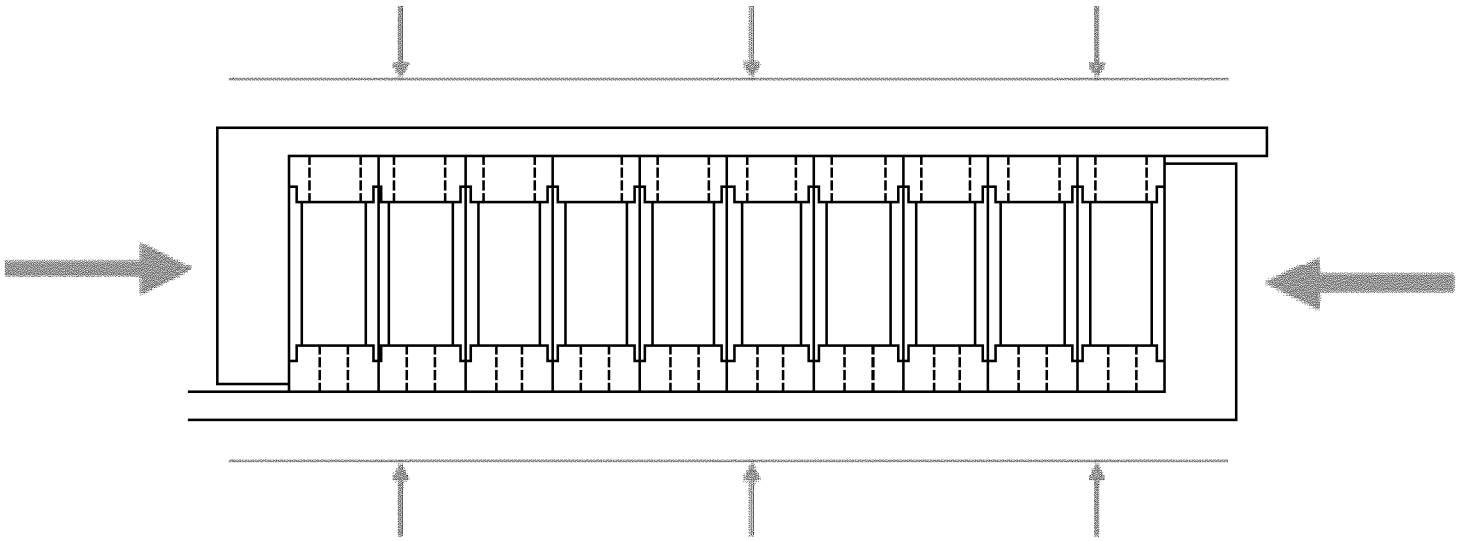
FIG. 13A shows a pressing step for assembling rebate joint cartridges as part of a method of manufacturing a panel according to an embodiment.
Figure 13B:
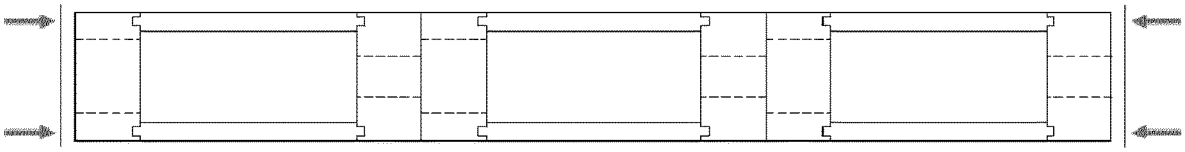
FIG. 13B shows a pressing step for assembling tongue and groove joint cartridges as part of a method of manufacturing a panel according to an embodiment.
Figure 13C:
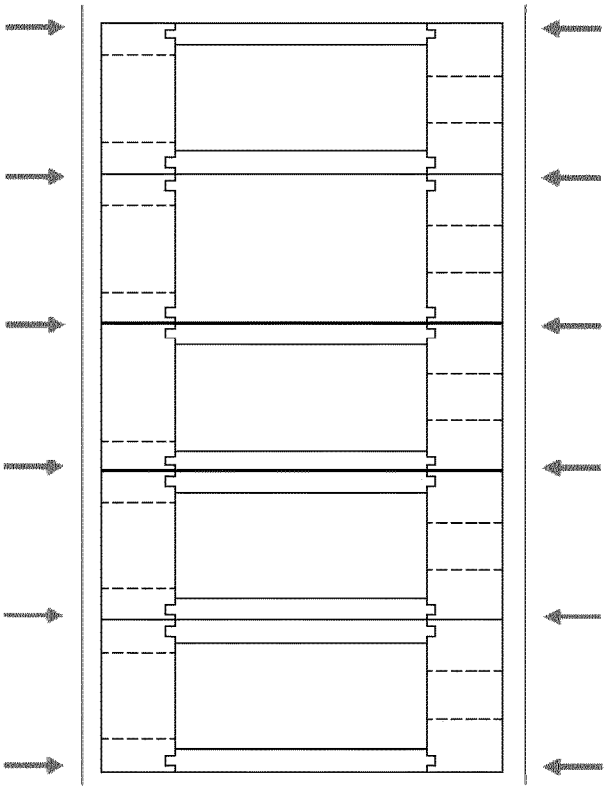
FIG. 13C shows a pressing step for assembling tongue and groove joint cartridges as part of a method of manufacturing a panel according to an embodiment.
Figure 13D:
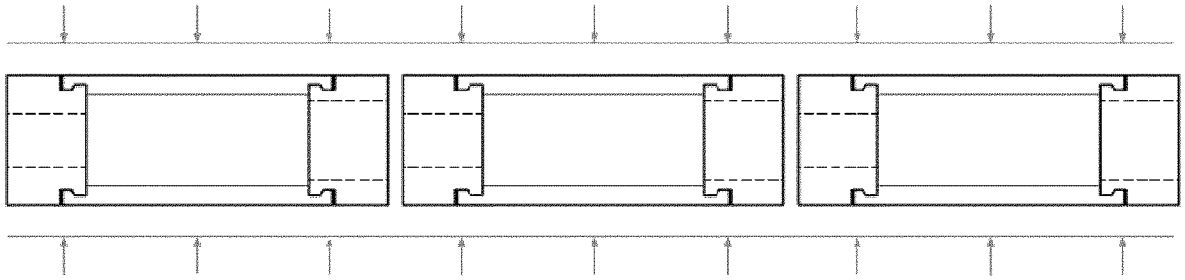
FIG. 13D shows a pressing step for assembling drawer lock joint cartridges as part of a method of manufacturing a panel according to an embodiment.
Figure 13E:
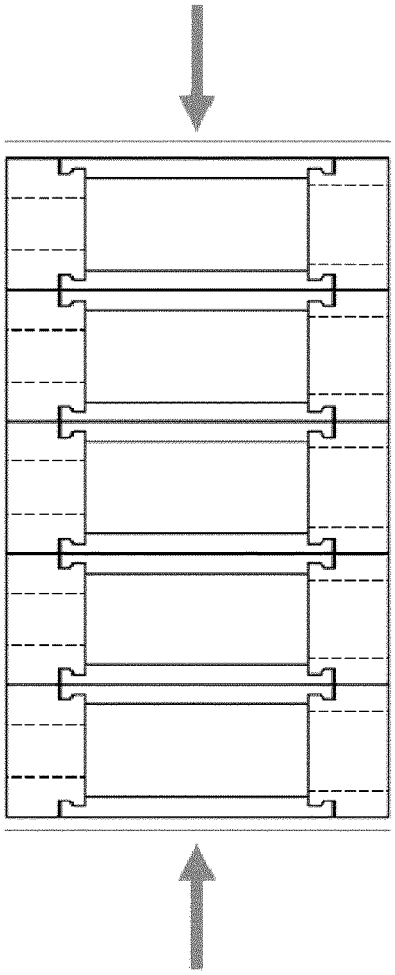
FIG. 13E shows a pressing step for assembling drawer lock joint cartridges as part of a method of manufacturing a panel according to an embodiment.

As shown in FIG. 13A to 13E, in some embodiments prior to step c. of the method of manufacturing panels the cartridges may be manufactured by: (i) gluing the proximally facing side, the distally facing side, and two backers together to form a cartridge; (ii) stacking a plurality of cartridges from step (i); and (iii) pressing against the stack of cartridges vertical and/or horizontal directions. As shown in FIG. 13A, rebate joints require pressure in both directions, while as shown in FIGS. 13B and 13C, tongue and groove joints require horizontal pressure, and while as shown in FIGS. 13D and 13E, draw lock joints require vertical pressure.

In yet other embodiments, the cartridges may be constructed of other materials and be printed, injection molded or extruded.

Core

Figure 14A:
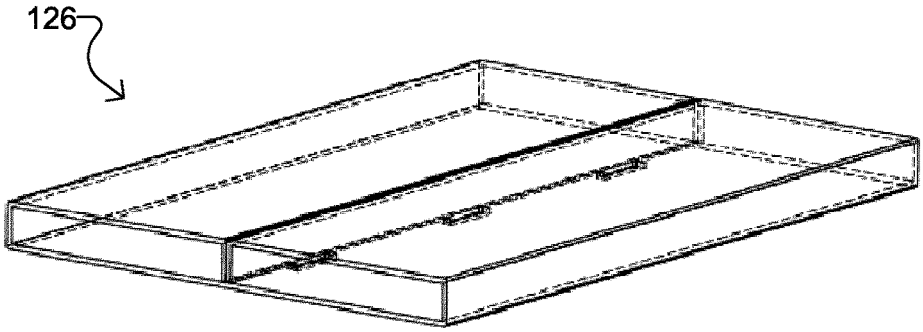
FIG. 14A is a perspective view of a dual channel core element of a panel according to the embodiment shown in FIG. 2A.
Figure 14B:
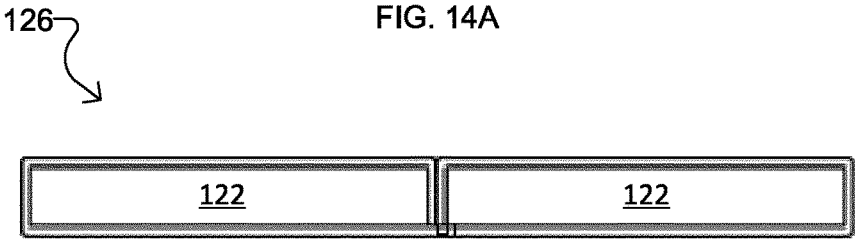
FIG. 14B is a side view of the dual channel core element shown in FIG. 14A.
Figure 14C:
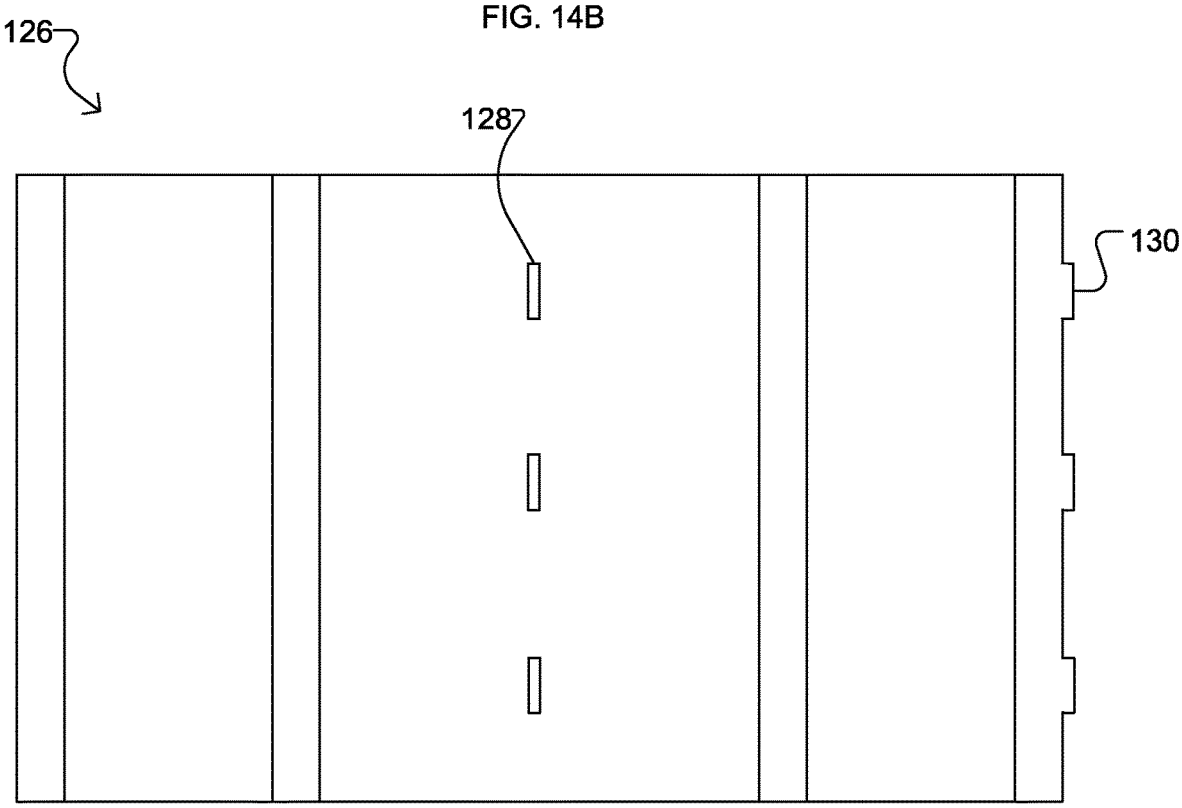
FIG. 14C is a plan view of a blank of the dual channel core element shown in FIG. 14A.

In panel 100, core assembly 120 is formed from six dual channel core elements 126. Core assembly 120 occupies all or substantially all of the space between the pair of cartridges 140 and rails 104. FIGS. 14A to 15B show dual channel core element 126. Each dual channel core element 126 has two horizontal channels 122. FIG. 14C shows a blank for dual channel core element 126. The blank is folded as shown in FIG. 14B, with tabs 130 inserted in scoring 128. Blanks of core element 126 can be folded by hand or automation.

Core assembly 120, and therefore in the case of panel 100, core elements 126, may be constructed from corrugated fiberboard. Corrugated fiberboard material is lightweight compared to other wood composite fibreboards, inherently sound absorptive, inexpensive, and can be produced cut to size with precision. Further, the relative elasticity of corrugated fiberboard limits mechanical connection between skins 108, 110, thereby isolating vibration and sound transmission. Constructing core assembly 120 from corrugated fiberboard therefore provides both structure (stiffness and compressive strength) and sound adsorption for panel 100.

Figure 15A:
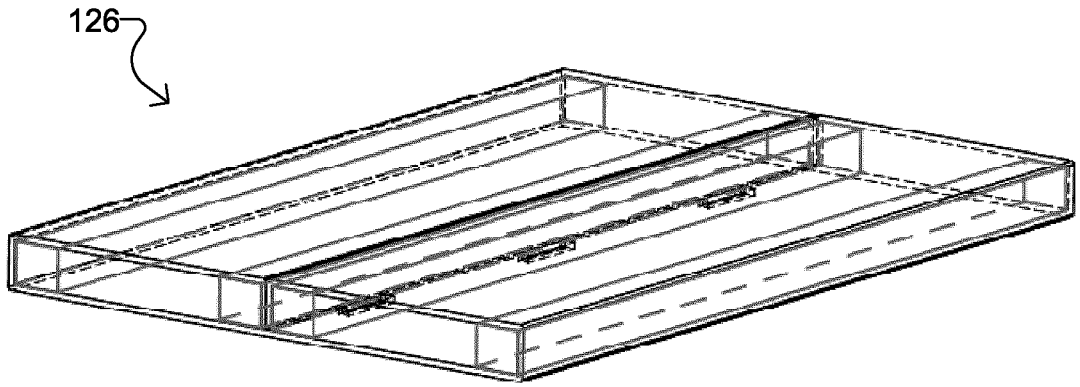
FIG. 15A is a perspective view of the dual channel core element shown in FIG. 14A with sound absorbing linings.
Figure 15B:
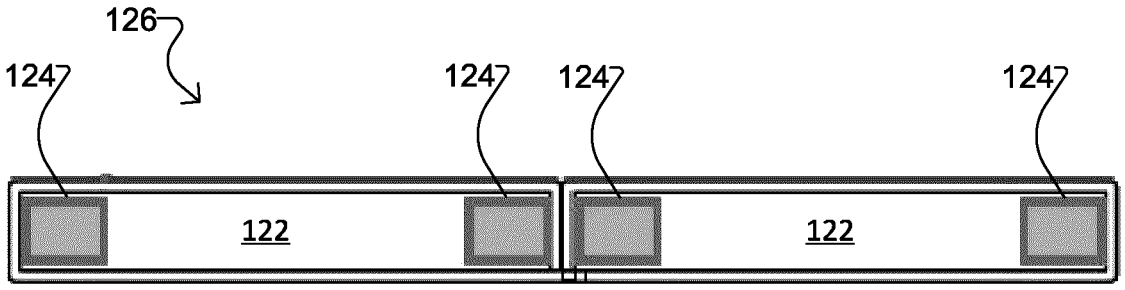
FIG. 15B is a side view of the dual channel core element shown in FIG. 15A.

In some embodiments core element 126 includes sound absorbing linings 124 as shown in FIGS. 15A and 15B for additional sound absorption in core assembly 120. Sound absorbing linings 124 may be made of a suitable sound absorbing material such as open cell foam, mineral wool and fiberglass.

Figure 19A:
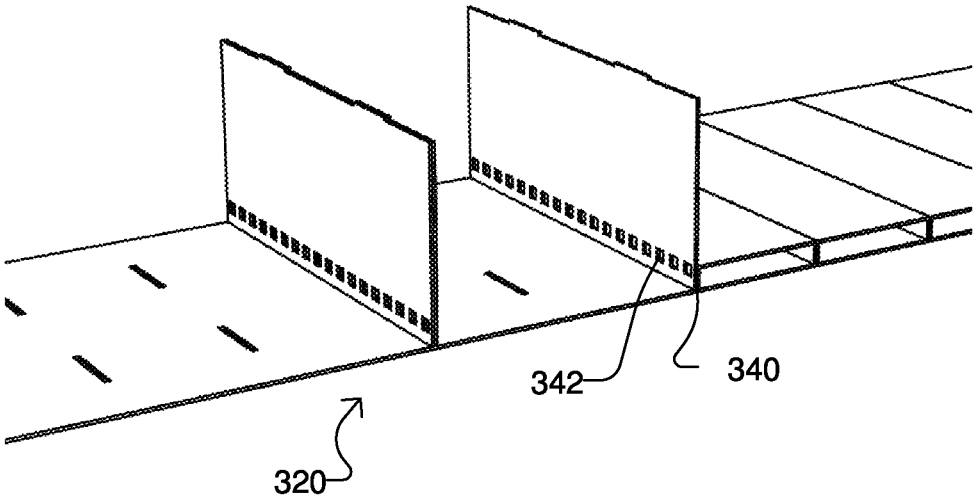
FIGS. 19A and 19B are side views showing construction of a core assembly of a panel according to an embodiment.
Figure 19B:
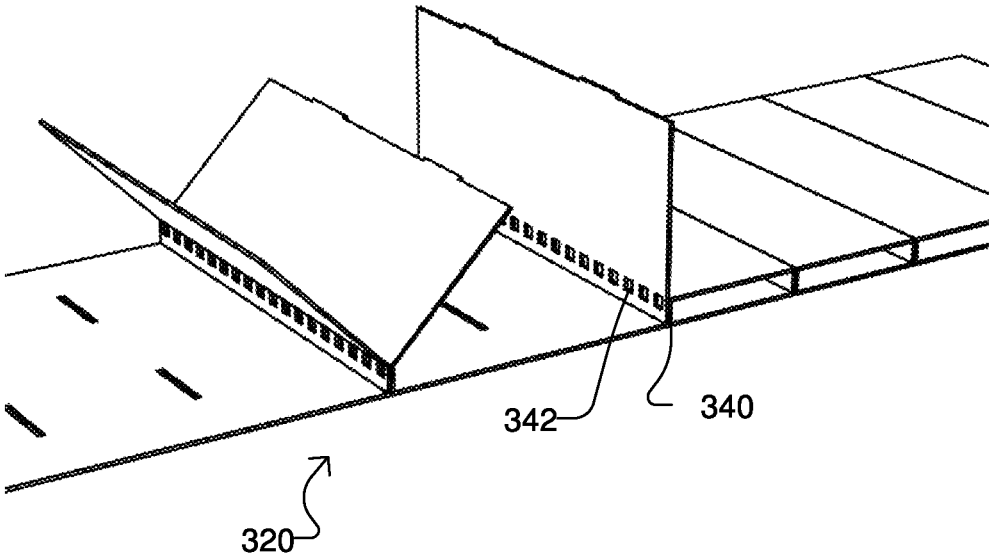
Figure 20:
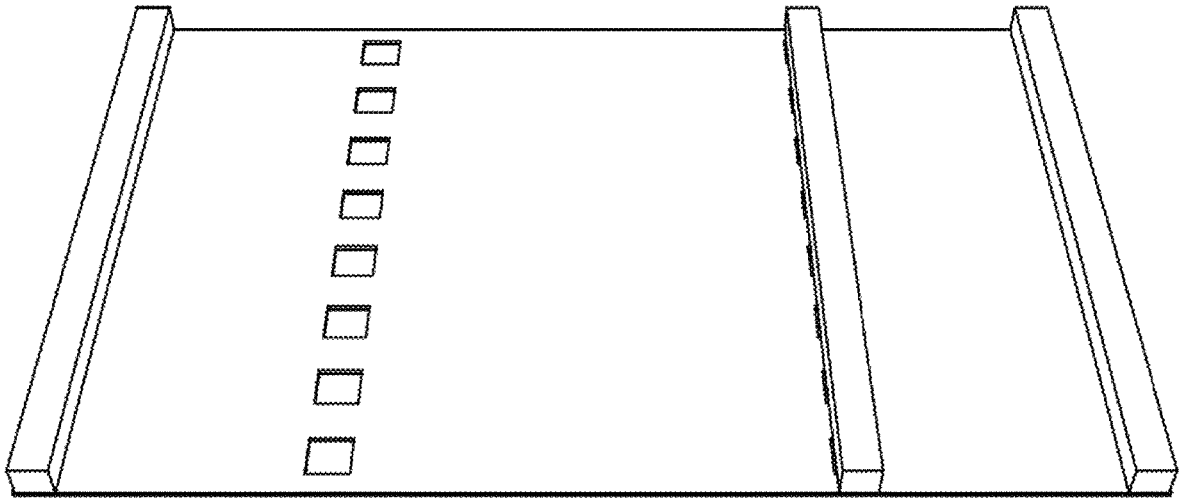
FIG. 20 is a front view of a blank of a core element of a panel according to an embodiment.

As shown in FIGS. 19A, 19B and 20, in some embodiments the core element may include a plurality of apertures 342 in the walls 340 separating the horizontal channels. Apertures 342 can further increase sound absorption of the core assembly 120.

Figure 16:
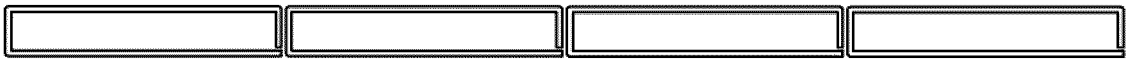
FIG. 16 is a side view of a plurality of single channel core elements of a panel according to an embodiment.

In some embodiments, the core assembly may include 6 to 24 adjacently arranged horizontal channels. Instead of a dual channel core element, in some embodiments the core elements may be a single channel or a triple channel, for example. FIG. 16, for example, shows a plurality of single channel core elements, assembled and then attached to one another by an adhesive, such as hot melt glue.

Figure 17:
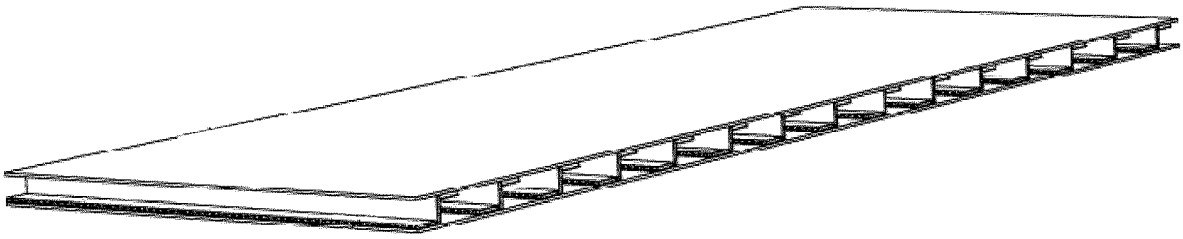
FIG. 17 is a perspective view of a core assembly of a panel according to an embodiment.
Figure 18A:
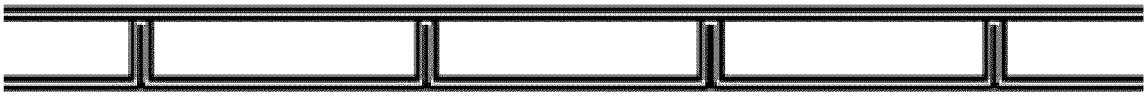
FIG. 18A is a partial side view of a core assembly of a panel according to an embodiment.
Figure 18B:
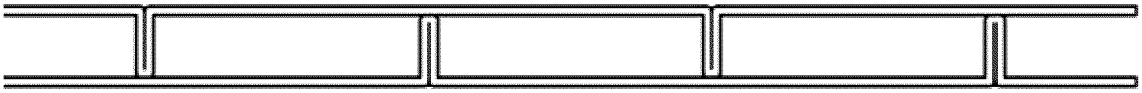
FIG. 18B is a partial side view of a core assembly of a panel according to an embodiment.
Figure 18C:
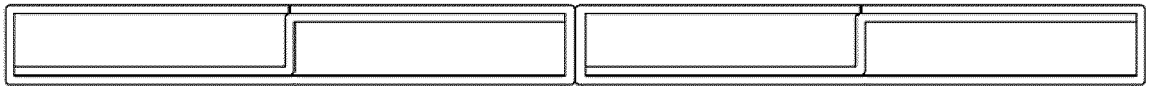
FIG. 18C is a partial side view of a core assembly of a panel according to an embodiment.

FIG. 17 shows a core assembly according to another embodiment. Instead of core elements, the core assembly is constructed of two flat sheets connected by a series of separators with Z-shaped cross-sections. The separators define the horizontal channels. FIGS. 18A to 18C show partial cross-sections of yet other embodiments of core assemblies. FIG. 18A shows a core assembly with a flat sheet connected to a ridged sheet. FIG. 18B shows a core assembly with two alternatingly ridged sheets. FIG. 18C shows a core assembly with dual channel core elements with interior separators having Z-shaped cross-sections.

Where a component (e.g. rail, stile, skin, channel, lining, aperture, groove, etc.) is referred to above, unless otherwise indicated, reference to that component should be interpreted as including as equivalents of that component any component which performs the function of the described component (i.e. that is functionally equivalent), including components which are not structurally equivalent to the disclosed structure which performs the function in the illustrated exemplary embodiments of the invention.

While a number of exemplary aspects and embodiments have been discussed above, those of skill in the art will recognize certain modifications, permutations, additions and sub-combinations thereof.

It is therefore intended that the following appended claims and claims hereafter introduced are interpreted to include all such modifications, permutations, additions and sub-combinations as are consistent with the broadest interpretation of the specification as a whole.

The invention claimed is:

1. A sound isolating ventilation panel comprising:

a core assembly comprising a plurality of horizontal channels;

a pair of cartridges comprising hollow centers and flanking both sides of the core assembly; and a pair of hollow sides flanking the pair of cartridges;

wherein each of the cartridges comprises a proximally facing side comprising a plurality of air channel side apertures and a distally facing side comprising a plurality of sound resonator side apertures;

wherein a vertically oriented ventilation groove is formed through a front face of a first one of the cartridges and a vertically oriented ventilation groove is formed through a back face of the second one of the cartridges;

whereby the ventilation grooves, the hollow centers, the air channel side apertures and the horizontal channels together partially define Z-shaped air channels; and whereby the sound resonator side apertures and the hollow sides partially define a plurality of resonators.

2. A sound isolating ventilation panel according to claim 1 further comprising:

a frame comprising a top rail, a bottom rail and two stiles, wherein the pair of cartridges are disposed between the top rail and bottom rail, and wherein the top rail, the bottom rail, the two stiles and the distally facing sides partially define the hollow sides; and a front skin and a back skin, wherein the frame, core assembly and the pair of cartridges are supportively disposed between the front skin and the back skin, and wherein the vertically oriented ventilation groove formed through the front face of the first one of the cartridges is also formed through the front skin, and the vertically oriented ventilation groove formed through the back face of the second one of the cartridges is also formed through the back skin.

3. A sound isolating ventilation panel according to claim 2 wherein each of the cartridges has a horizontal plane of symmetry and a vertical plane of symmetry.

4. A sound isolating ventilation panel according to claim 3 wherein each of the plurality of air channel side apertures align with a corresponding one of the plurality of horizontal channels.

5. A sound isolating ventilation panel according to claim 4 wherein the plurality of air channel side apertures are identical and equidistantly spaced, and the plurality of sound resonator side apertures are identical and equidistantly spaced.

6. A sound isolating ventilation panel according to claim 5 wherein the plurality of air channel side apertures are larger than and fewer in number than the plurality of sound resonator side apertures.

7. A sound isolating ventilation panel according to claim 6 wherein the plurality of air channel side apertures are arranged linearly in series, and wherein the plurality of sound resonator side apertures are arranged linearly in series.

8. A sound isolating ventilation panel according to claim 7 wherein each space between the air channel side apertures is at least one inch, wherein each of the cartridges extend at least 80%, or at least 90% of a height of the panel, wherein the horizontal channels are at least partially formed from folded corrugated fiberboard, wherein interior surfaces of the horizontal channels comprise sound absorbing linings of a porous, dissipative material such as open cell foam, mineral wool or fiberglass, wherein the core assembly occupies substantially all of the space between the pair of cartridges, wherein the core assembly comprises 6 to 24 adjacently arranged horizontal channels, wherein walls between adjacent horizontal channels comprise a plurality of apertures to increase exposed surface area of sound absorbing linings, wherein the hollow sides comprise porous, dissipative sound absorbing material.

9. A sound isolating ventilation panel according to claim 1, the core assembly further comprising a core component, the core component comprising a single corrugated fiberboard sheet folded to define two ventilation channels having rectangular cross sections.

10. A sound isolating ventilation panel according to claim 9, wherein the sheet comprises a plurality of linearly arranged slots at a mid portion of the sheet and corresponding plurality of tabs at an end of the sheet for engaging the slots to facilitate forming at least one of the channels, wherein the two channels are equally sized.

11. A method of manufacturing a sound isolating ventilation panel comprising:

a. providing a frame comprising a top rail, a bottom rail and two stiles;

b. providing a core assembly comprising a plurality of horizontal channels;

c. providing a pair of cartridges comprising hollow centers, the cartridges positioned between the top rail and the bottom rail and flanking both sides of the core assembly, wherein each of the cartridges comprises a proximally facing side comprising a plurality of air channel side apertures aligned with the plurality of horizontal channels, and a distally facing side comprising a plurality of sound resonator side apertures;

d. providing a front skin and a back skin, whereby the sound resonator side apertures and a space between the stiles, the distally facing side and the front and back skins define resonators;

e. forming a vertically oriented ventilation groove through the front skin and a front face of a first one of the cartridges, and forming a vertically oriented ventilation groove through the back skin and a back face of the second one of the cartridges, whereby the ventilation grooves, the hollow centers, the air channel side apertures and the horizontal channels together define Z-shaped air channels.

12. A method of manufacturing a sound isolating ventilation panel according to claim 11, wherein step c. further comprises inserting an insert into each of the cartridges, wherein the insert comprises blocking portions and receiving portions, the blocking portions for substantially blocking off the air channel side apertures and sound resonator side apertures from the receiving portions which are configured to receive dust and debris generated by step e. regardless of whether the vertically oriented ventilation grooves are formed in the front or back of the cartridge, and wherein after step e. the insert is removed from the cartridges through the vertically oriented ventilation grooves.

13. A method of manufacturing a sound isolating ventilation panel according to claim 12, wherein prior to step c. the proximally facing side and the distally facing side are manufactured by: (i) making cuts in a rectangular block having the length of the cartridges, (ii) stacking the cut blocks, and (iii) boring air channel side apertures or sound resonator side apertures through the stacked blocks.

14. A method of manufacturing a sound isolating ventilation panel according to claim 12, wherein prior to step c. the proximally facing side and the distally facing side are manufactured by: (i) boring slots sized to the air channel side apertures or the sound resonator side apertures through an elongated rectangular block having the length of the cartridges; (ii) making joinery profile cuts in the bored elongated rectangular block, (iii) ripping the profiled and bored elongated block into individual proximally facing sides or distally facing sides.

15. A method of manufacturing a sound isolating ventilation panel according to claim 12, wherein prior to step c. the proximally facing side and the distally facing side are manufactured by: (i) providing two sheets each having the length of the cartridges; (ii) sandwiching spaced apart ribs between the sheets, the spacing of the ribs matching the dimensions of the air channel side apertures or the sound resonator side apertures; and (iii) cutting the sheets into strips of the proximally facing sides or the distally facing sides.

16. A method of manufacturing a sound isolating ventilation panel according to claim 12, wherein prior to step c. the cartridges are manufactured by: (i) gluing the proximally facing side, the distally facing side, and two backers together to form a cartridge; (ii) stacking a plurality of cartridges from step (i); and (iii) pressing against the stack of cartridges in vertical and/or horizontal directions.

17. A cartridge for a sound isolating ventilation panel, the cartridge comprising:

a hollow center;

a front face;

a back face opposite the front face;

a proximally facing side comprising a plurality of air channel side apertures;

a distally facing side comprising a plurality of sound resonator side apertures; and a vertically oriented ventilation groove formed through the front face or the back face a horizontal plane of symmetry and a vertical plane of symmetry; wherein the plurality of air channel side apertures are identical and equidistantly spaced, and the plurality of sound resonator side apertures are identical and equidistantly spaced; wherein the plurality of air channel side apertures are larger than and fewer in number than the plurality of sound resonator side apertures, wherein the plurality of air channel side apertures are arranged linearly in series, and wherein the plurality of sound resonator side apertures are arranged linearly in series, wherein each space between the air channel side apertures is at least one inch.

* * * * *